US005659162A

United States Patent [19]

Hart

[11] Patent Number: 5,659,162

[45] Date of Patent: Aug. 19, 1997

[54] SWITCH ASSEMBLY

[75] Inventor: Roy L. Hart, Laguna Niguel, Calif.

[73] Assignee: Eaton Corporation, Cleveland, Ohio

[21] Appl. No.: 495,175

[22] Filed: Jun. 27, 1995

[51] Int. Cl.[6] ..... H01H 13/00

[52] U.S. Cl. ..... 200/16 A; 200/314; 200/341

[58] Field of Search ..... 200/5 A, 16 R–16 F, 200/402, 405–409, 445, 446, 447, 448–454, 456–468, 520–523, 530–532, 534, 535, 308, 310, 313, 314, 317, 329, 341

[56] References Cited

U.S. PATENT DOCUMENTS

| | | | |
|---|---|---|---|
| 3,274,354 | 9/1966 | Stevens | 200/76 |
| 3,315,535 | 4/1967 | Stevens | 74/100 |
| 3,319,021 | 5/1967 | Good | 200/67 |
| 3,467,802 | 9/1969 | Martin | 200/167 |
| 3,766,350 | 10/1973 | Van Dyk et al. | 200/167 A |
| 3,789,173 | 1/1974 | Bury | 200/153 J |
| 4,056,701 | 11/1977 | Weber | 200/314 |
| 4,354,078 | 10/1982 | Yoshimura | 200/314 |
| 4,365,903 | 12/1982 | Zeller et al. | 400/490 |
| 5,122,626 | 6/1992 | Shinohara et al. | 200/457 |

OTHER PUBLICATIONS

Publication entitled "4–Lamp Lighted Pushbutton Switches", Series 10E & 10H Twist–Lite, published by Eaton Corporation. Exact publication date is unknown but is prior to Jan. 1, 1995.

*Primary Examiner*—Michael L. Gellner

*Assistant Examiner*—Michael A. Friedhofer

*Attorney, Agent, or Firm*—Tarolli, Sundheim, Covell, Tummino & Szabo

[57] ABSTRACT

A switch assembly includes a housing having a plurality of terminals at one end and a push-button at the opposite end. An actuator mechanism is disposed in the housing and is connected with the push-button. The actuator mechanism is operable to move movable switch contacts relative to stationary switch contacts upon manual actuation of the push-button. A printed circuit extends between terminals at one end of the housing and the push-button. The printed circuit has a zig-zag portion disposed within the housing to accommodate movement of the push-button relative to the housing. The push-button is at least partially illuminated by light sources mounted on the printed circuit. The actuator mechanism includes a plurality of longitudinally extending actuator levers which are connected with the movable switch contacts and are pivotally connected with an actuator link. During actuation or release of the push-button, actuator link springs store energy which assists actuator lever springs in effecting rapid movement of the movable switch contacts relative to the stationary switch contacts.

77 Claims, 8 Drawing Sheets

SWITCH ASSEMBLY

BACKGROUND OF THE INVENTION

The present invention relates to a new and improved switch assembly.

Known push-button switch assemblies have previously been used to perform many different control functions. Some of these known push-button switch assemblies contain light sources which are selectively energized to illuminate indicia. Since the switch assemblies may be used in an environment where there is a limited amount of space and reliability is important, such as in an aircraft, the switch assemblies should be as compact as possible, be reliable in operation, and have a relatively long service life. Of course, the cost of the switch assemblies should be minimized.

SUMMARY OF THE INVENTION

The present invention provides a new and improved switch assembly having a housing with a manually actuatable push-button at one end. An actuator mechanism is disposed within the housing and is operable to move movable switch contacts relative to stationary switch contacts upon manual actuation of the push-button.

A printed circuit may advantageously be disposed within the housing. The printed circuit may have an end portion connected with the push-button. Light sources may be disposed on the end portion of the printed circuit to illuminate the push-button. A portion of the printed circuit may have a zig-zag configuration to accommodate movement of the push-button relative to the housing.

The actuator mechanism disposed within the housing may include a plurality of actuator levers. Movable switch contacts may be disposed at one end portion of each of the actuator levers and a second end portion of each of the actuator levers may be connected with an actuator link. The actuator link may be movable relative to the housing to pivot the actuator levers about the end portions upon which the movable switch contacts are disposed. Actuator lever springs may be provided to move the movable switch contacts relative to stationary switch contacts.

BRIEF DESCRIPTION OF THE DRAWINGS

The foregoing and other features of the invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 1:
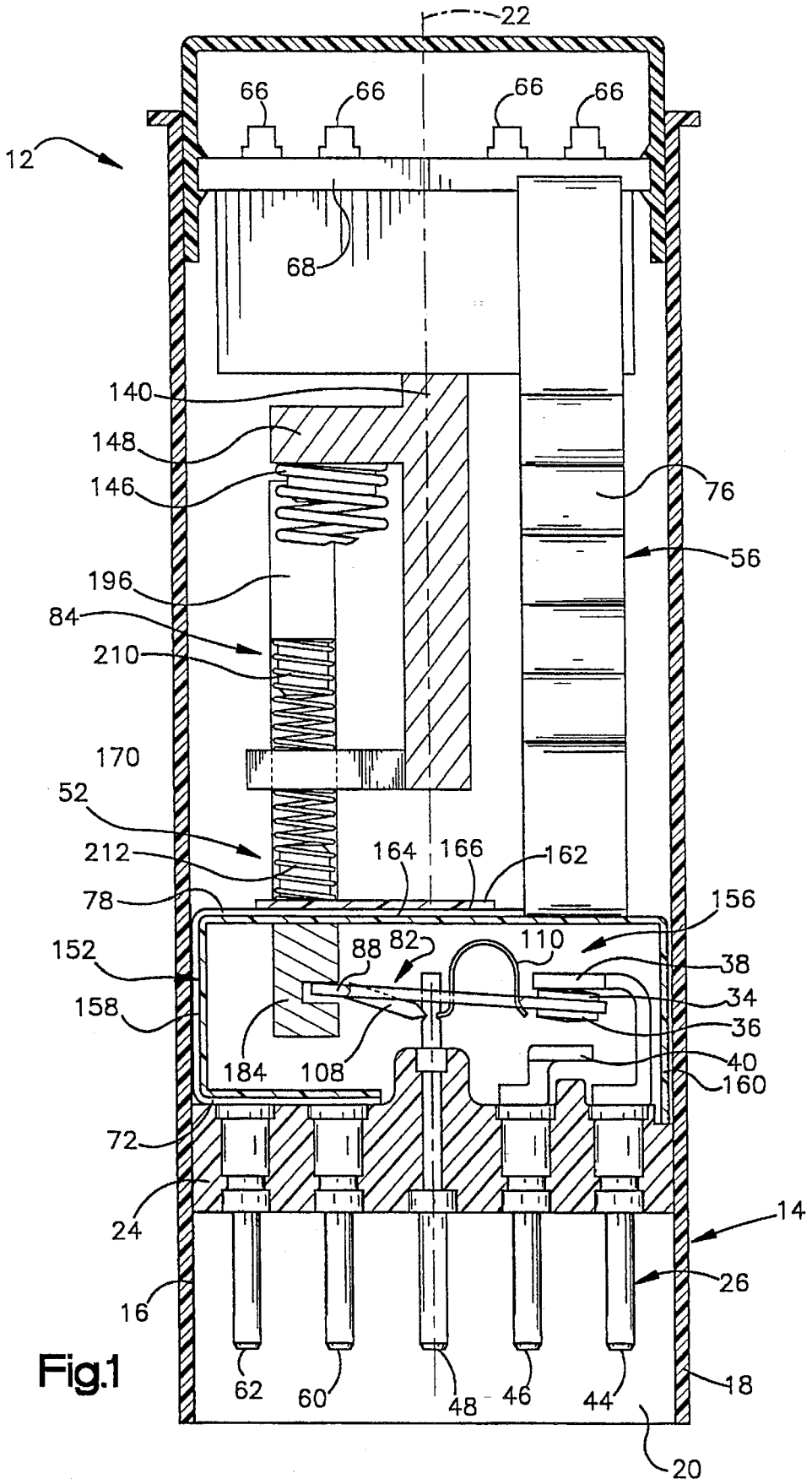
FIG. 1 is a somewhat simplified and schematicized sectional illustration of a switch assembly constructed in accordance with the present invention.

A switch assembly 12, constructed in accordance with the present invention, is illustrated in FIG. 1. The switch assembly 12 includes a rectangular housing 14. The housing 14 has parallel side walls 16 and 18. The side walls 16 and 18 are interconnected by a second pair of parallel side walls 20, only one of which is shown in FIG. 1. The housing 14 has a central axis 22 which extends parallel to the side walls 16, 18 and 20.

The switch assembly 12 includes a rectangular end wall 24 at one end of the housing 14. Terminals 26 extend outward from the end wall 24. The end wall 24 is formed of an electrically insulating polymeric material. Although the terminals 26 are enclosed by the housing 14, the terminals could project from the housing if desired.

The opposite end of the housing 14 is closed by a rectangular push-button 32. The push-button 32 is manually movable axially relative to the housing 14 to actuate the switch assembly 12. Manual actuation of the push-button 32 effects movement of movable switch contacts 34 and 36 relative to upper and lower (as viewed in FIG. 1) stationary switch contacts 38 and 40.

Figure 2:
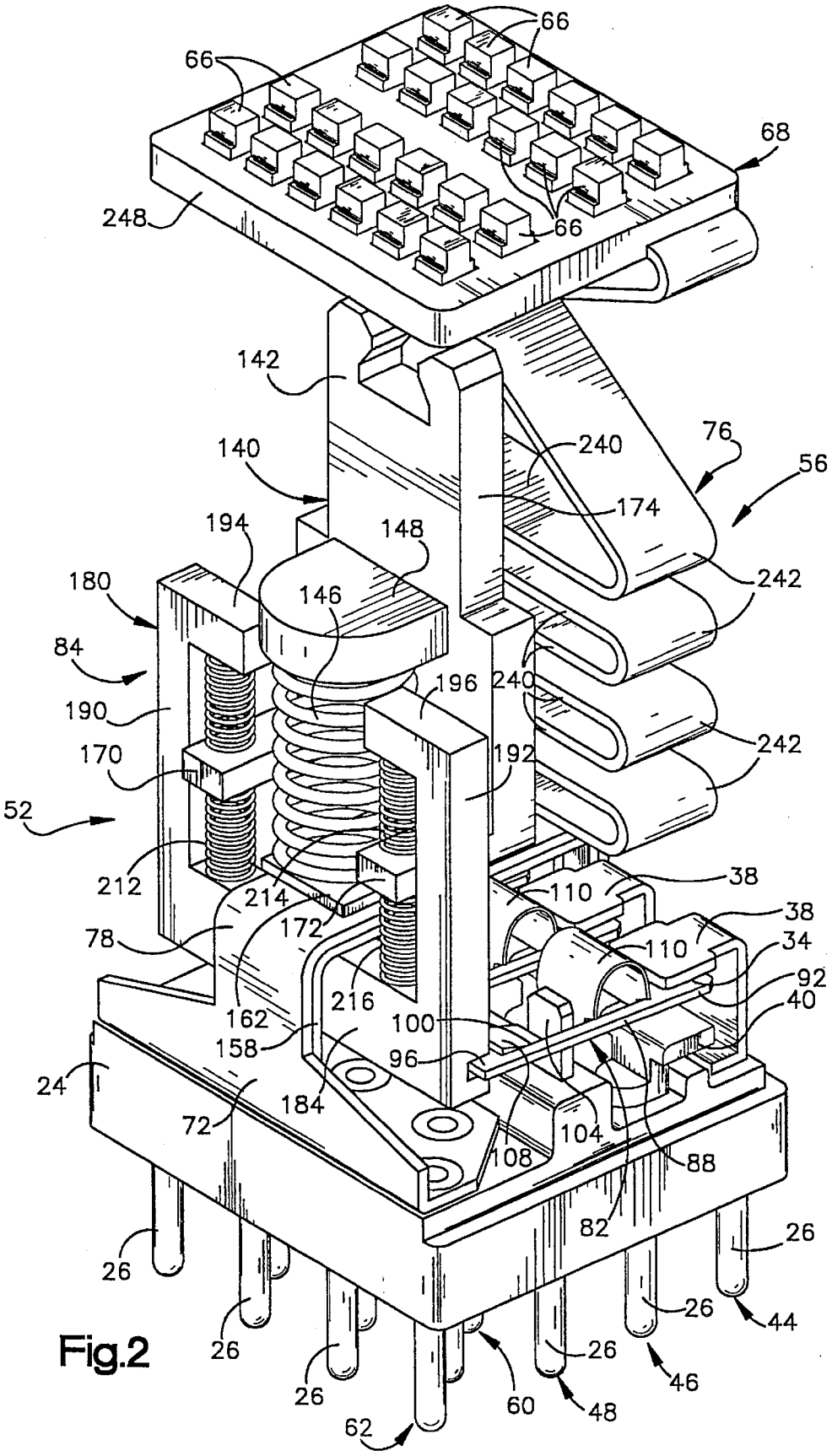
FIG. 2 is a somewhat simplified and schematicized perspective illustration of some of the components of the switch assembly of FIG. 1.

Although only a single upper stationary switch contact 38 is illustrated in FIG. 1, it should be understood that there are a plurality of upper stationary switch contacts disposed in a linear array (FIG. 2). Each of the upper stationary switch contacts 38 is connected with a terminal 26 in a first row 44 of terminals. Although only a single lower stationary switch contact 40 is illustrated in FIG. 1, it should be understood that there are a plurality of lower stationary switch contacts disposed in a linear array. Each of the lower stationary switch contacts 40 is connected with a terminal 26 in a second row 46 of terminals.

Although only the movable switch contacts 34 and 36 are shown in FIG. 1, it should be understood that there are a plurality of movable switch contacts disposed in a linear array. Each pair of movable switch contacts 34 and 36 is disposed between an upper stationary switch contact 38 and a lower stationary switch contact 40. The movable switch contacts 34 and 36 are connected with terminals 26 in a third row 48 of terminals.

An actuator mechanism 52 (FIGS. 1 and 2), constructed in accordance with one of the features of the present invention, is operable to move the movable switch contacts 34 and 36 relative to the upper and lower stationary switch contacts 38 and 40. Upon manual actuation of the push-button 32 (FIG. 1), the actuator mechanism 52 is operable to move the movable switch contacts 34 and 36 from an initial or unactuated position (FIG. 3) to an actuated position (FIG. 4). When the movable switch contacts 34 and 36 are in the unactuated position (FIG. 3), the movable switch contact 34 is in engagement with the upper stationary switch contact 38. When the movable switch contacts 34 and 36 are in the actuated position (FIG. 4), the movable switch contact 36 is in engagement with the lower stationary switch contact 40.

Figure 3:
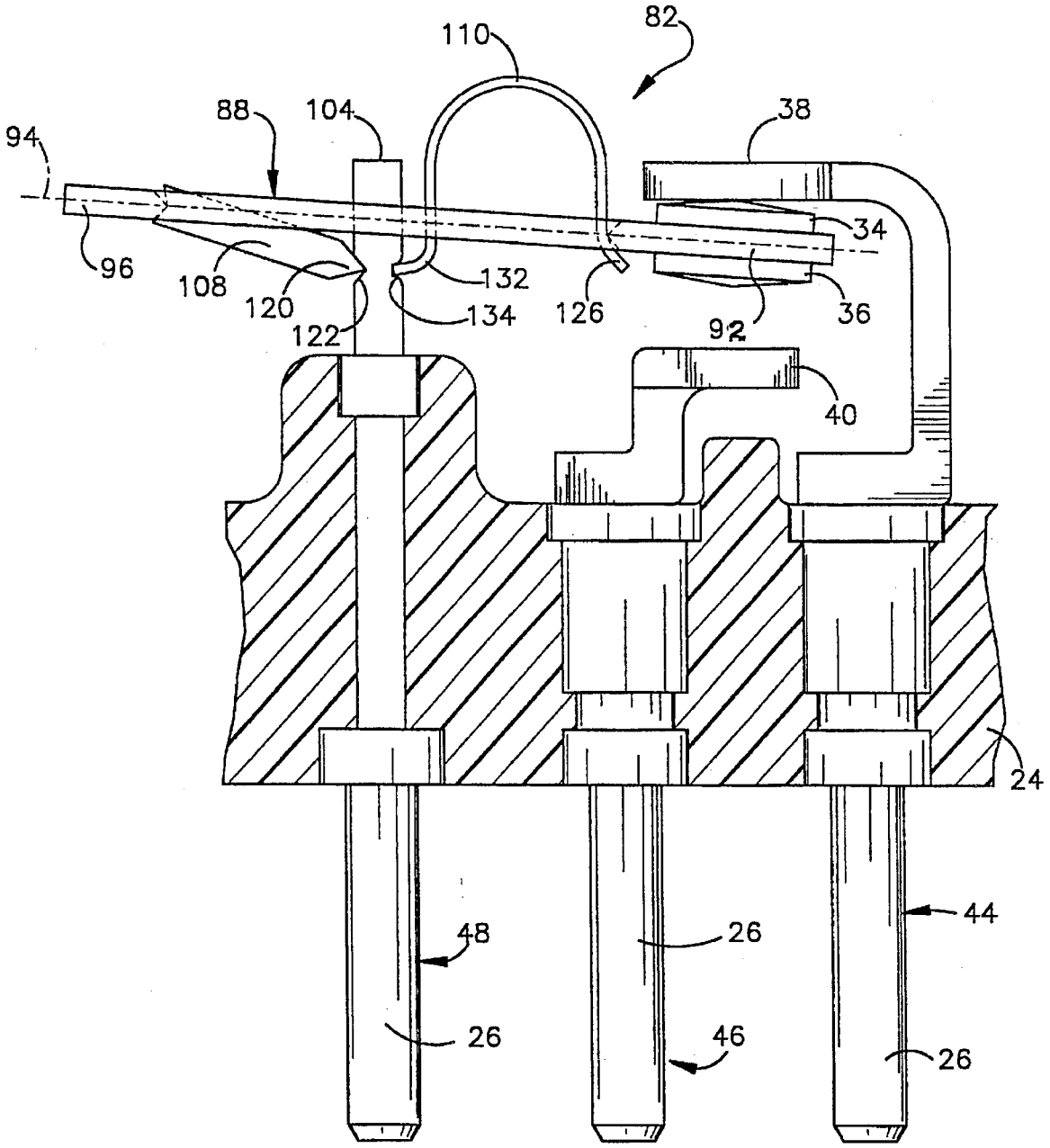
FIG. 3 is a somewhat simplified and schematicized enlarged fragmentary sectional illustration of the relationship between movable and stationary switch contacts and an actuator lever system when the switch assembly of FIG. 1 is in an initial or unactuated condition.
Figure 4:
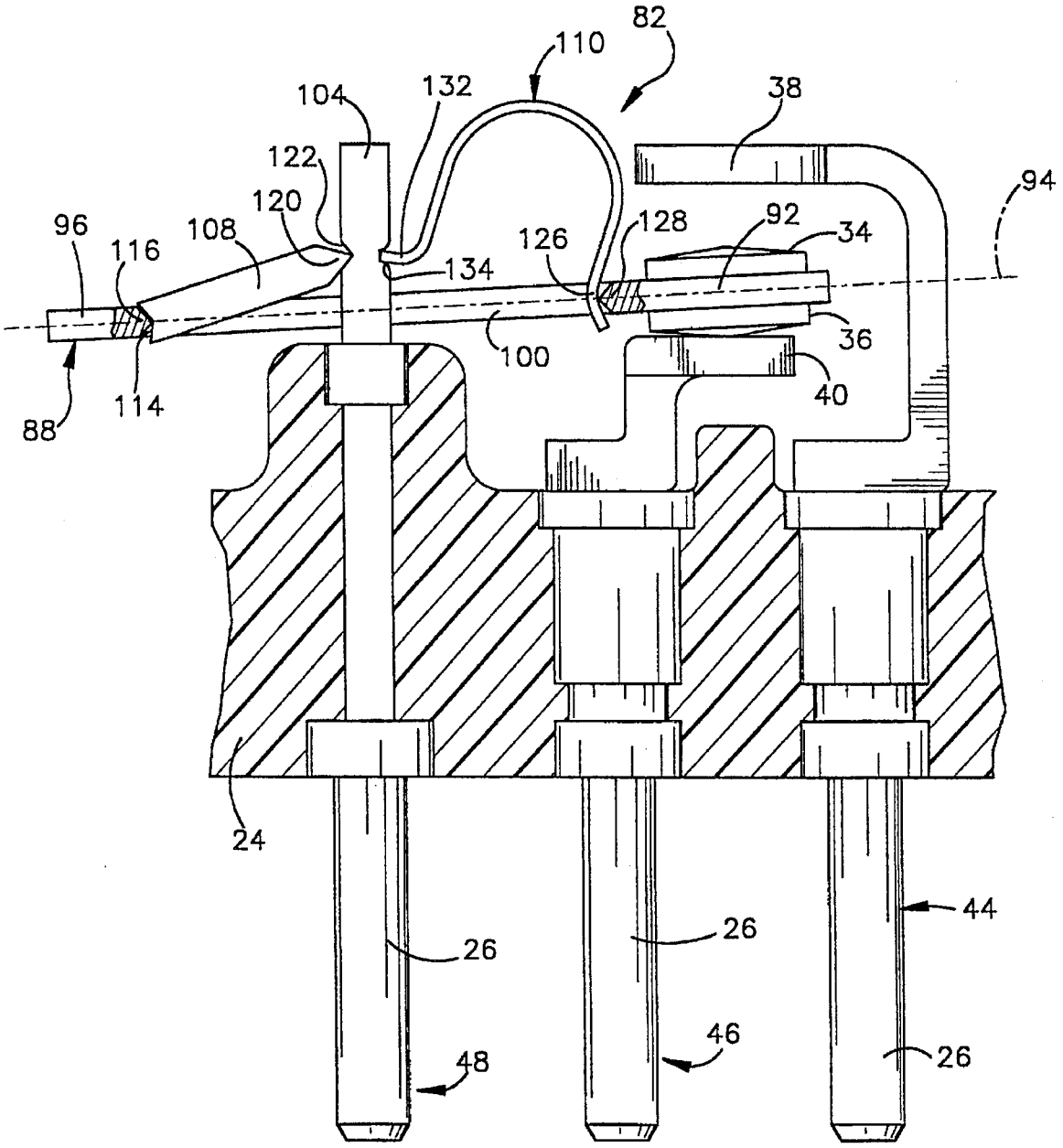
FIG. 4 is a somewhat simplified and schematicized fragmentary sectional illustration, similar to FIG. 3, of the relationship between the actuator lever system and the switch contacts when the switch assembly is in an actuated condition.

Upon manual release of the push-button 32, the actuator mechanism 52 moves the movable switch contacts 34 and 36 from the actuated position (FIG. 4) back to the unactuated position (FIG. 3). Thus, the movable switch contact 36 moves out of engagement with the lower stationary switch contact 40. Immediately thereafter, the movable switch contact 34 moves into engagement with the upper stationary switch contact 38.

In accordance with another of the features of the present invention, a printed circuit 56 (FIGS. 1 and 2) conducts electrical energy to the push-button 32 (FIG. 1). In the illustrated embodiment of the invention, the printed circuit 56 conducts electrical energy from terminals 26 in fourth and fifth rows 60 and 62 of terminals to the push-button 32. Electrical energy conducted through the printed circuit 56 is effective to energize light sources 66 disposed in the push-button 32 on an upper end portion 68 of the printed circuit 56.

The light sources 66 are light emitting diodes. However, the light sources 66 could be other sources of light, such as conventional incandescent lamps or a liquid crystal display.

The upper end portion 68 (FIG. 2) of the printed circuit 56 is reinforced so that it is relatively inflexible. The upper end portion 68 of the printed circuit 56 is fixedly connected to the push-button 32. The upper end portion 68 of the printed circuit 56 supports the light sources 66 in predetermined positions relative to the push-button 32 during movement of the push-button and upper end portion 68 of the printed circuit relative to the housing 14.

A lower end portion 72 (FIG. 1) of the printed circuit 56 is connected with terminals 26 in the fourth and fifth rows 60 and 62 of terminals. The printed circuit 56 includes suitable conductors which enable various combinations of the light sources 66 (FIG. 2) to be energized depending upon electrical signals transmitted to the terminals 26 in the fourth and fifth rows 60 and 62 of terminals. However, the lower end portion 72 of the printed circuit 56 could be connected with sources of electrical energy other than the terminals 26 in the fourth and fifth rows 60 and 62 of terminals. For example, the lower end portion 72 of the printed circuit 56 could be connected with terminals 26 in the first, second and third rows 44, 46 and 48 of terminals.

In accordance with another of the features of the invention, the upper end portion 68 (FIG. 2) of the printed circuit 56 is connected with the lower end portion 72 of the printed circuit through a zig-zag intermediate portion 76 (FIG. 2). The zig-zag intermediate portion 76 of the printed circuit 56 accommodates relative movement between the housing 14 and the push-button 32. This relative movement may occur during actuation of the push-button 32 or during assembly of the switch assembly 12.

In accordance with another of the features of the invention, the zig-zag portion 76 of the printed circuit 56 is connected with the lower end portion 72 of the printed circuit by a connector portion 78. The connector portion 78 of the printed circuit 56 extends through the actuator mechanism 52. By extending the connector portion 78 of the printed circuit 56 through the actuator mechanism 52, a compact relationship is obtained between the printed circuit, actuator mechanism, and switch contact 34, 36, 38 and 40.

The compact arrangement of the printed circuit 56 and the actuator mechanism 52 in the housing 14 along with the movable and stationary switch contacts 34, 36, 38 and 40, is promoted by having the zig-zag portion 76 of the printed circuit disposed in the housing between the switch contacts and the push-button 32 (FIG. 1). The zig-zag portion 76 of the printed circuit 56 is disposed adjacent to the side wall 18 of the housing 14. The actuator mechanism 52 is disposed adjacent to the opposite side wall 16 of the housing 14. The connector portion 78 of the printed circuit 56 extends from the lower end portion 72 of the printed circuit through the actuator mechanism 52 to the zig-zag portion 76 of the printed circuit.

Although the various features of the present invention are advantageously included in a single switch assembly 12, one or more of the features may be omitted if desired. For example, the actuator mechanism 52 could be used without the printed circuit 56. Alternatively, the printed circuit 56 could be used with an actuator mechanism having a substantially different construction than the actuator mechanism 52.

Actuator Mechanism—General Description

The actuator mechanism 52 includes a plurality of actuator lever systems 82, constructed in accordance with one of the features of the invention. The actuator lever systems 82 are connected with the movable switch contacts 34 and 36 (FIG. 1). The actuator mechanism 52 also includes an actuator linkage 84, constructed in accordance with one of the features of the invention. The actuator linkage 84 is connected with the push-button 32 and with the plurality of actuator lever systems 82 (FIG. 2).

Upon manual actuation of the push-button 32, the actuator linkage system 84 operates the actuator lever systems 82. Operation of the actuator lever systems 82 quickly moves the movable switch contacts 34 and 36 away from the upper stationary switch contacts 38 toward the lower stationary switch contacts 40. Upon release of the push-button 32, the actuator linkage system 84 operates the actuator lever systems 82 to quickly move the movable switch contacts 34 and 36 away from the lower stationary switch contacts 40 toward the upper stationary switch contacts 38.

Figure 5:
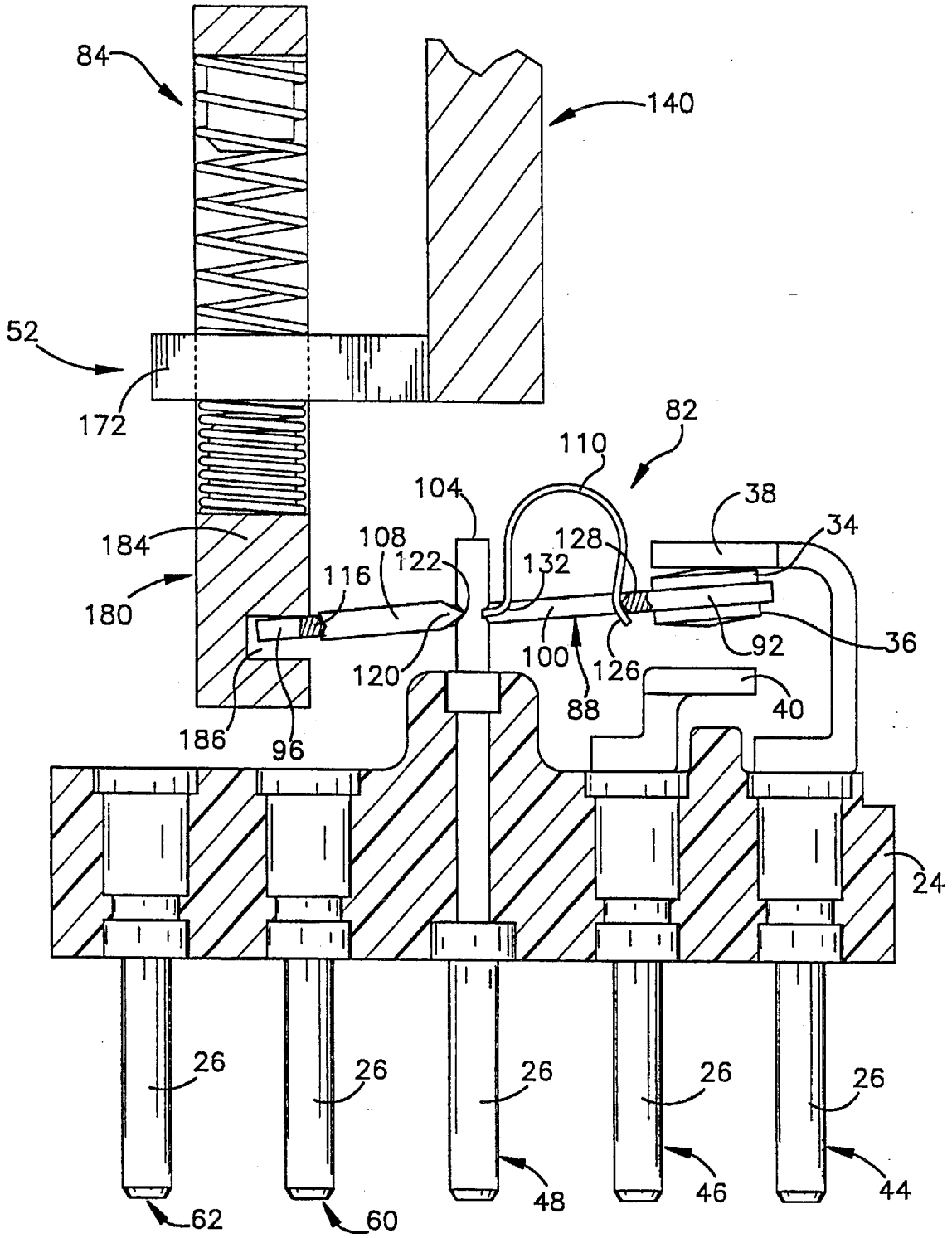
FIG. 5 is a somewhat simplified and schematicized fragmentary sectional illustration of the relationship between the switch contacts, actuator lever system, and an actuator linkage system connected with a push-button after partial manual actuation of the push-button.

Each of the identical actuator lever systems 82 includes a straight rectangular metal actuator lever 88 (FIGS. 2, 3, 4 and 8). The actuator lever 88 has a first end portion 92 (FIG. 3) on which the movable switch contacts 34 and 36 are mounted. The actuator lever 88 has a longitudinal central axis 94 which extends through opposite side walls 16 and 18 of the housing 14. The actuator lever 88 has a second end portion 96 which is connected with the actuator linkage system 84 (FIGS. 2 and 5).

Upon manual actuation of the push-button 32 and initial operation of the actuator mechanism 52, the actuator linkage system 84 is operable to pivot the actuator lever 88 about the first end portion 92 of the actuator lever. Thus, the second end portion 96 of the actuator lever 88 is moved downward from the position shown in FIG. 3 toward the intermediate position shown in FIG. 5 by the actuator linkage system 84. As this occurs, the actuator lever 88 is pivoted in a counterclockwise direction about the first end portion 92 of the actuator lever and the movable switch contact 34. At this time the movable switch contact 34 is disposed in engagement with the upper stationary switch contact 38.

Figure 6:
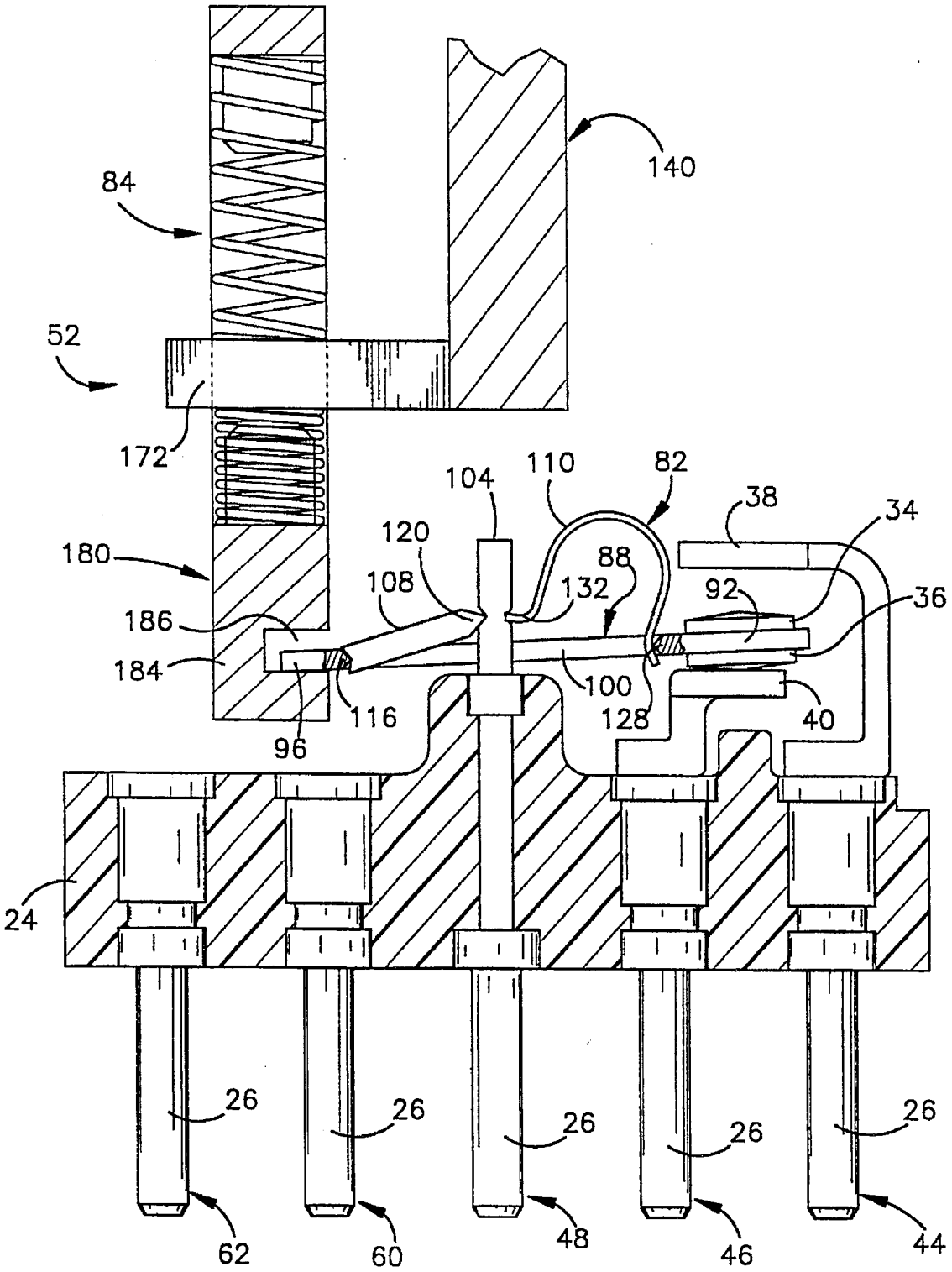
FIG. 6 is a somewhat simplified and schematicized fragmentary sectional view, generally similar to FIG. 5, illustrating the relationship between the switch contacts, actuator lever system, and actuator linkage system when the switch assembly has been operated to an actuated condition.

Continued manual actuation of the push-button 32 causes the actuator lever system 82 to pivot the actuator lever 88 relative to the actuator linkage system 84. The actuator lever system 82 pivots the actuator lever 88 about the second end portion 96 of the actuator lever 88. Pivotal movement of the actuator lever 88 moves the movable switch contact 34 (FIG. 5) out of engagement with the upper stationary switch contact 38. As this occurs, the movable switch contact 36 moves into engagement with the lower stationary switch contact 40 (FIG. 6). Thus, the actuator lever 88 is pivoted in a clockwise direction about the second end portion 96 of the actuator lever to move the first end portion 92 of the actuator lever and the movable switch contacts 34 and 36 relative to the upper and lower stationary switch contacts 38 and 40.

Figure 7:
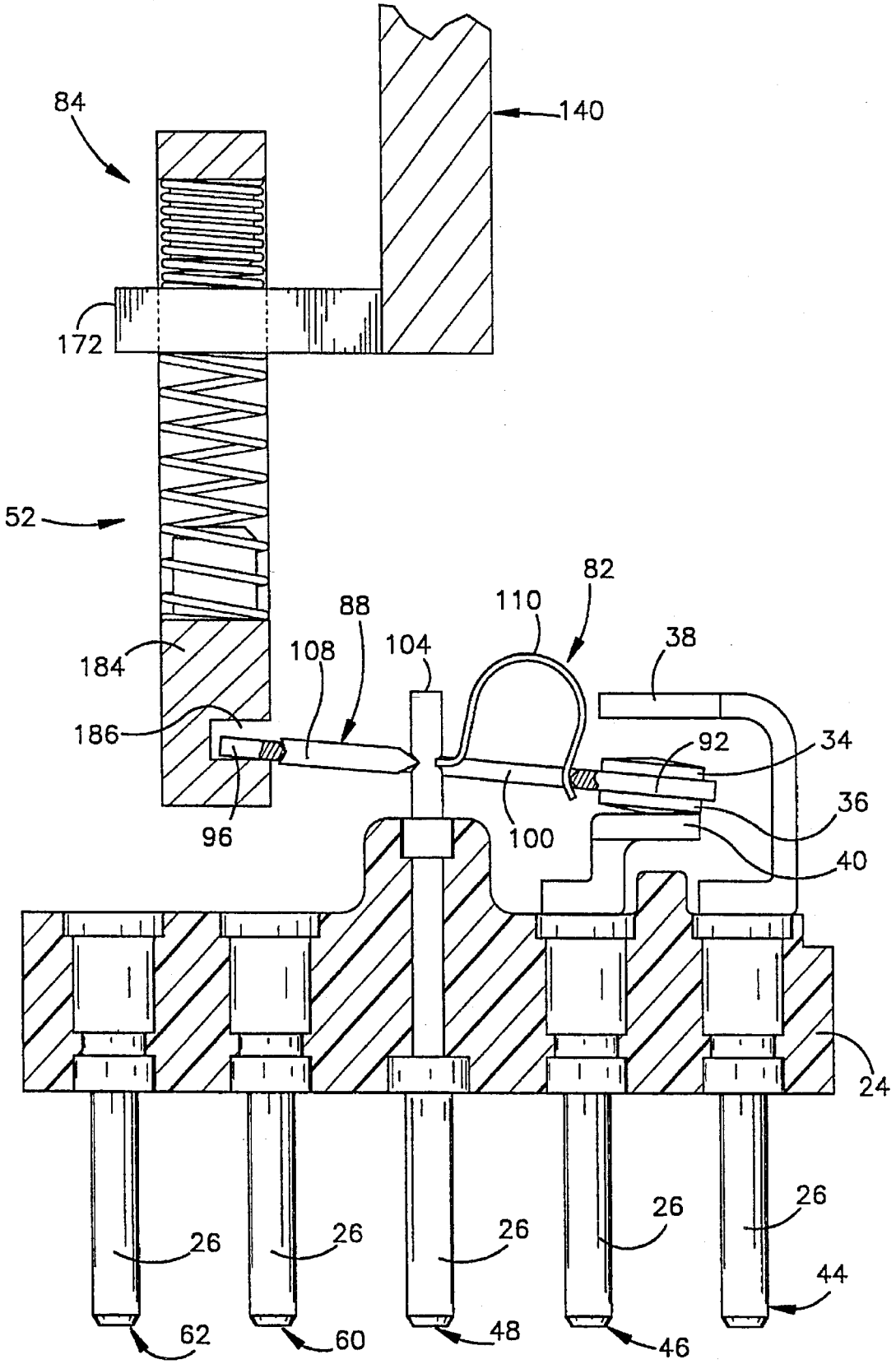
FIG. 7 is a somewhat simplified and schematicized fragmentary sectional view, generally similar to FIGS. 5 and 6, illustrating the relationship between the switch contacts, actuator lever system, and actuator linkage system upon partial operation of the switch assembly of FIG. 1 from the actuated condition of FIG. 4 back toward the unactuated condition of FIG. 3.

Upon initial manual release of the push-button 32 (FIG. 1), the actuator linkage system 84 pivots the actuator lever 88 about the first end portion 92 from the position shown in FIG. 6 toward the intermediate position shown in FIG. 7. Thus, the actuator lever 88 is pivoted in a clockwise direction about the first end portion 92. As this pivotal movement of the actuator lever 88 occurs, the movable switch contact 36 remains in engagement with the lower stationary switch contact 40.

Continued movement of the push-button 32 back toward the initial or unactuated position causes the actuator lever system 82 to pivot the actuator lever 88 about the second end portion 96 of the actuator lever. This moves the movable switch contact 36 out of engagement with the lower stationary switch contact 40 (FIG. 7) and moves the movable switch contact 34 into engagement with the upper stationary switch contact 38 (FIG. 3). As this occurs, the actuator lever 88 is pivoted in an counterclockwise direction about the second end portion 96 of the actuator lever.

Continued movement of the push-button 32 back toward the initial or unactuated condition causes the actuator linkage system 82 to pivot the actuator lever 88 about the second end portion 92 of the actuator lever. As this pivotal movement occurs, the movable switch contact 34 remains in engagement with the upper stationary switch contact 38 and the actuator lever 88 is pivoted in a clockwise direction about the first end portion 92.

Actuator Mechanism—Actuator Lever System

Figure 8:
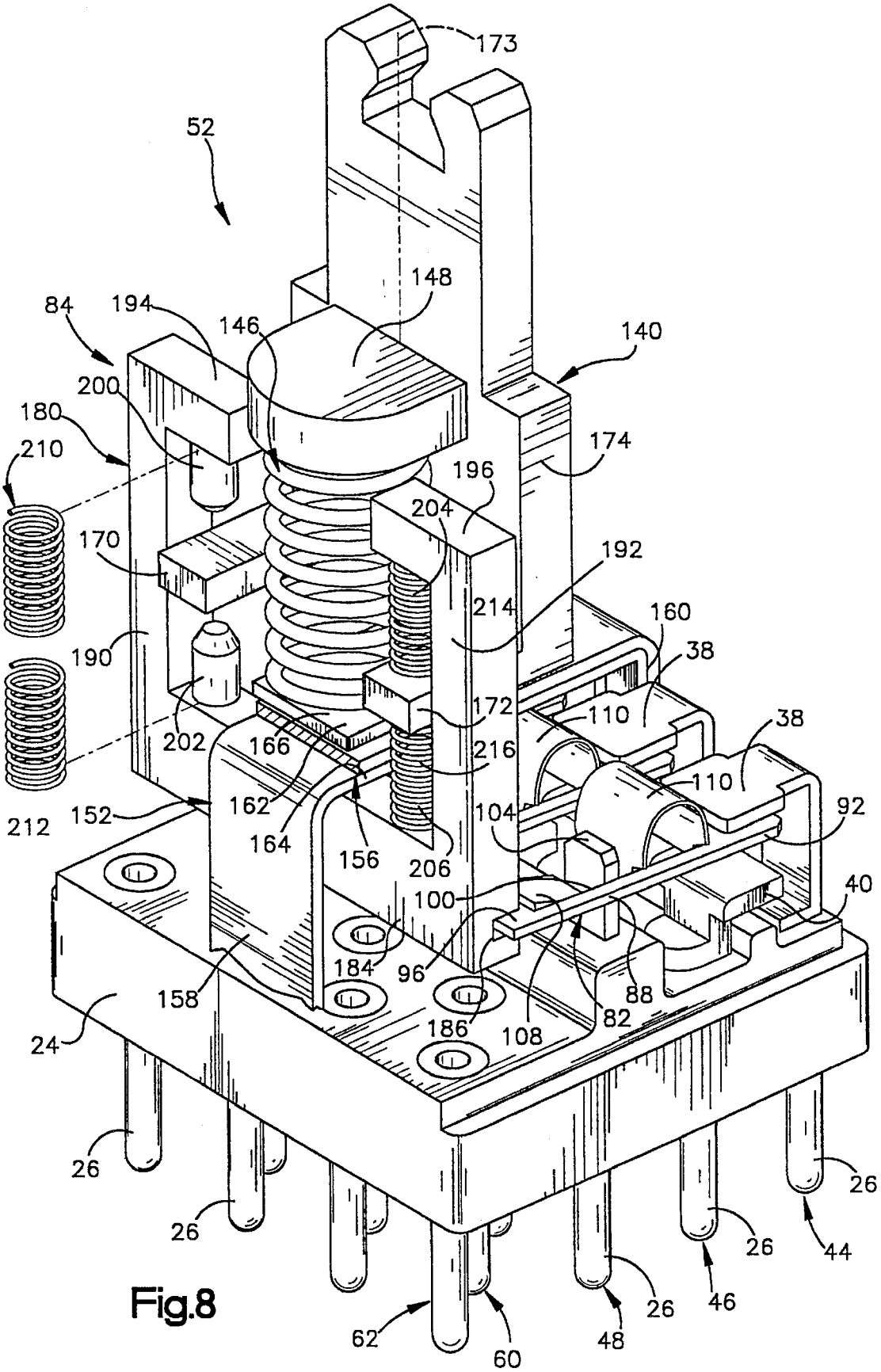
FIG. 8 is an enlarged and partially exploded perspective illustration which is somewhat simplified and schematicized and is generally similar to FIG. 2, of some of the components of the switch assembly of FIG. 1 and further illustrating the relationship between the switch contacts, actuator lever system and actuator linkage system.

The metal actuator lever 88 has a rectangular central opening 100 (FIGS. 2, 4 and 8). A pivot post or member 104 extends through the opening 100 in the actuator lever 88. The pivot post 104 is connected with a terminal 26 in the third row 48 of terminals.

When the movable switch contact 34 is in engagement with the upper stationary contact 38 (FIG. 3), a circuit is completed, through the actuator lever 88, between a terminal 26 in the first row 44 and a terminal 26 in the third row 48 of terminals. Similarly, when the movable switch contact 36 is in engagement with the lower stationary switch contact 40 (FIG. 4), a circuit is completed, through the actuator lever 88, between a terminal 26 in the second row 46 and the terminal 26 in the third row 48.

The metal actuator lever 88 is connected with the pivot post 104 by a pivot lever 108 (FIG. 4) and an actuator lever spring 110. The pivot lever 108 and actuator lever spring 110 are formed of metal and conduct electrical energy between the pivot post or member 104 and the metal actuator lever 88.

The metal pivot lever 108 has a recess 114 formed in the left (as viewed in FIG. 4) end portion of the pivot lever. The recess 114 in the end portion of the pivot lever 108 engages a knife edge 116 at the left (as viewed in FIG. 4) end of the opening 100 in the metal actuator lever 88. The opposite end of the pivot lever 100 has a knife edge 120 which engages a recess 122 in the metal pivot post 104.

The metal actuator lever spring 110 has an end portion 126 which engages a knife edge 128 at the right (as viewed in FIG. 4) end of the opening 100 in the actuator lever 88. The actuator lever spring 110 has a second end 132 which engages a recess 134 in the pivot post 104. The actuator lever spring 110 is a flexible leaf type metal spring having a generally U-shape configuration.

When the actuator lever 88 is in the unactuated position shown in FIG. 3 with a movable switch contact 34 in engagement with the upper stationary switch contact 38, the actuator lever spring 110 provides a biasing force urging the actuator lever 88 to pivot in a counterclockwise direction about the end portion 96 of the actuator lever. This force presses the movable switch contact 34 against the upper stationary switch contact 38. In addition, the actuator lever spring 110 applies a force against the actuator lever 88 urging the actuator lever toward the right (as viewed in FIG. 3) along the longitudinal central axis 94 of the actuator lever 88. This results in the pivot lever 108 being pressed firmly against the pivot post 104 by the actuator lever 88.

When the actuator lever 88 is in the actuated position shown in FIG. 4 with the movable switch contact 36 in engagement with the lower stationary switch contact 40, the actuator lever spring 82 provides a biasing force urging the actuator lever 88 to pivot in a clockwise direction about the end portion 96 of the actuator lever. This force presses the movable switch contact 36 against the lower stationary switch contact 40. In addition, the actuator lever spring 110 applies a force against the actuator lever 88 urging the actuator lever toward the right (as viewed in FIG. 4) along the longitudinal central axis 94 of the actuator lever. This results in the pivot lever 108 being pressed firmly against the pivot post 104 by the actuator lever 88.

When the movable switch contacts 34 and 36 are moved from the position shown in FIG. 3 engaging the upper stationary switch contact 38 to the position shown in FIG. 4 engaging the lower stationary switch contact 40, the actuator lever 88 is first pivoted in a counterclockwise direction about the end portion 92 by the actuator linkage system 84. As this occurs, the end portion 96 of the actuator lever 88 moves into alignment with the recess 122 in the pivot post or member 104 (FIG. 5). Simultaneously therewith, the pivot lever 108 moves from a downward and rightward (as viewed in FIG. 3) sloping orientation toward a horizontal orientation (FIG. 5). As this occurs, the pivot lever 108 causes the actuator lever 88 to shift axially toward the left (as viewed in FIGS. 3 and 5). This results in a sliding or wiping of the movable switch contact 34 along the upper stationary switch contact 38.

In addition, as the actuator lever 88 is moved from the orientation shown in FIG. 3 to the orientation shown in FIG. 5, the force applied by the actuator spring 110 against the actuator lever opposing pivotal movement of the actuator lever about the end portion 92 decreases. Thus, the force applied by the actuator spring 110 pressing the movable switch contact 34 against the upper stationary switch contact 38 decreases as the end portion 126 of the actuator spring 110 moves into alignment with the end portion 132 of the actuator spring. When the end portions 126 and 132 of the actuator lever spring 110 are aligned (FIG. 5), the actuator lever spring is ineffective to resist further pivotal movement of the actuator lever 88.

After the actuator lever 88 has been moved to the position shown in FIG. 5, the next increment of counterclockwise pivotal movement of the actuator lever about the end portion 92 of the actuator lever by the actuator linkage system 84, results in the actuator lever spring 110 being moved to an overcenter condition. As this occurs, the actuator lever spring 110 urges the end portion 92 of the actuator lever downward toward the lower stationary switch contact 40 with a snap action. At the same time, the actuator linkage system 84 and the actuator spring 110 cooperate to pivot the actuator lever 88 in a clockwise direction about the end portion 96 of the actuator lever. This results in the movable switch contact 36 moving quickly downward into engagement with the lower stationary switch contact 40 (FIG. 6).

As this occurs, the pivot lever 108 moves from the horizontal (as viewed in FIG. 5) orientation to an upward and rightward sloping orientation (FIG. 6). This results in the actuator lever 88 being moved toward the right (as viewed in FIGS. 5 and 6) along its longitudinal central axis by the actuator lever spring 110. Therefore, as the movable switch contact 36 is moved into engagement with the stationary lower switch contact 40, the actuator lever 88 is moved axially to slide the movable switch contact 36 along the surface of the lower stationary switch contact 40 with a wiping action.

When the push-button 32 is released, the actuator lever 88 is first pivoted in a clockwise direction about the end portion 92 of the actuator lever by the actuator linkage system 84. As this occurs, the pivot lever 108 moves from the upward and rightward sloping orientation of FIG. 6 to the orientation of FIG. 7. Simultaneously therewith, the actuator lever 88 is shifted toward the left (as viewed in FIGS. 6 and 7) along its longitudinal central axis by the pivot lever 108. This results in a sliding of the movable switch contact 36 along the lower stationary switch contact 40. As the actuator lever 88 approaches the position shown in FIG. 7, the force applied against the actuator lever by the actuator lever spring 110 resisting pivotal movement of the actuator lever decreases.

The next increment of clockwise pivotal movement of the actuator lever 88 from the position shown in FIG. 7, about the end portion 92 of the actuator lever results in the actuator lever spring 110 moving through an overcenter condition. As this occurs, the actuator linkage system 84 and the actuator lever spring 110 cooperate to quickly move the actuator lever 88 from the position shown in FIG. 7 to the position shown in FIG. 3. As this occurs, the movable switch contact 34 moves into engagement with the upper stationary switch contact 38.

As the movable switch contact 34 is moved into engagement with the upper stationary switch contact 38, the pivot lever 108 moves from the horizontal orientation of FIG. 7 to the downward and rightward sloping orientation of FIG. 3. This results in a rightward (as viewed in FIG. 3) sliding movement of the movable switch contact 34 along the upper stationary switch contact 38 with a wiping action. This rightward sliding movement of the movable switch contact 34 occurs under the influence of force transmitted from the actuator lever spring 110 to the actuator lever 88.

The foregoing description of the manner in which the movable switch contacts 34 and 36 are moved into and out of engagement with the upper and lower stationary switch contacts 38 and 40 is in regard to an embodiment of the invention in which the switch assembly 12 is of the momentary actuation type. Thus, upon manual release of the push-button 32, the switch contacts are moved back to their initial positions. However, it is contemplated that the present invention could be utilized in association with a switch assembly of the alternate action type. Thus, it is contemplated that the switch assembly could be constructed in such a manner as to result in movement of the movable switch contacts 34 and 36 from the condition shown in FIG. 3 to the condition shown in FIG. 4 upon manual actuation and release of the push-button 32. Upon subsequent manual actuation and release of the push-button 32, the movable switch contacts 34 and 36 would be moved from the condition shown in FIG. 4 back to the condition shown in FIG. 3.

Actuator Mechanism—Actuator Linkage System

The actuator linkage system 84 (FIG. 1) interconnects the push-button 32 and the actuator lever system 82. Upon either actuation or release of the push-button 32, the actuator linkage system 84 stores energy. This stored energy is used to assist the actuator lever system 82 in quickly and positively moving the movable switch contacts 34 and 36 relative to the upper and lower stationary switch contacts 38 and 40.

Upon initial actuation of the push-button 32, the actuator linkage system 84 is operated to store energy while the actuator lever system 82 remains stationary. During continued actuation of the push-button 32, the stored energy in the actuator linkage system 84 is released. The release of stored energy by the actuator linkage system 84 assists the actuator lever system 82 to quickly and positively move the movable switch contacts 34 and 36 from the unactuated position shown in FIG. 3 to the actuated position shown in FIG. 4.

Similarly, upon initial release of the push-button 32 and movement of the push-button back toward its unactuated condition, the actuator linkage system 84 is operated to store energy while the actuator lever system 82 remains stationary. During continued movement of the push-button 32 back toward its unactuated condition, the stored energy in the actuator linkage system 84 is released. The release of stored energy by the actuator linkage system 84 assists the actuator lever system 82 to quickly move the movable switch contacts 36 out of engagement with the lower stationary switch contacts 40 (FIG. 4) and to move the movable switch contacts 34 into engagement with the upper stationary switch contacts 38 (FIG. 3).

The actuator linkage system 84 includes a generally L-shaped actuator member 140 (FIG. 2). The actuator member 140 has an upper (as viewed in FIG. 2) end portion 142 which is connected with a central portion of the push-button 32 (FIG. 1). A return spring 146 (FIG. 2) engages an outwardly projecting arm 148 on the actuator member 140 to urge the actuator member and push-button 32 upward (as viewed in FIG. 1) toward an initial or unactuated condition.

A lower (as viewed in FIG. 8) end portion of the return spring 146 engages a rigid bridge member 152. The bridge member 152 has a horizontal (FIG. 8) main section 156 and a pair of vertical leg sections 158 and 160. The main section 156 has an upper side wall 162 (FIG. 8) which cooperates with a lower side wall 164 to form a passage 166. The connector portion 78 of the printed circuit 56 (FIG. 2) extends through the passage 166. The printed circuit 56 has been omitted in FIG. 8 to more clearly illustrate the bridge member 152.

The lower end of the return spring 146 engages the upper side wall 162 of the bridge member 152 (FIG. 8). The force applied by the return spring 146 against the upper side wall 162 of the bridge member 152 is transmitted through the leg sections 158 and 160 of the rigid bridge member to the end wall 24 (FIG. 1) of the housing 14. The upper side wall 162 extends rightward (as viewed in FIGS. 1 and 8) along the lower side wall 164 of the main section 156 of the bridge member 152 to a location adjacent to the zig-zag portion 76 of the printed circuit 56 (FIG. 1). The upper side wall 162 (FIG. 8) of the bridge member 152 protects the connector portion 78 of the printed circuit 56 from engagement by the return spring 146. The bridge member 152 is formed of a rigid and electrically insulating polymeric material.

In addition to the arm 148 which is engaged by the return spring 146, the actuator member 140 has a pair of horizontal arms 170 and 172 (FIG. 8). The arms 170 and 172 have central axes which extend parallel to each other and to the arm 148. The central axes of the arms 170 and 172 extend perpendicular to and are offset to opposite sides of a vertical central axis 173 of a main body section 174 of the actuator member 140. The central axis 173 of the main body section 174 of the actuator member 140 extends through a central portion of the push-button 32 and is parallel to the central axis 22 of the switch assembly 12 (FIG. 1).

A generally rectangular actuator link 180 (FIG. 8) interconnects the actuator member 140 and the actuator lever system 82. The actuator link 180 is formed of an electrically insulating polymeric material. The actuator link 180 has a horizontal (as viewed in FIG. 8) base section 184 having a slot 186 in which the end portions 96 of the actuator levers 88 are loosely received (FIGS. 5 and 8). The slot 186 is large enough to enable an actuator lever 88 to pivot about both the end portion 96 of the actuator lever and the end portion 92 of the actuator lever.

In addition, the actuator link 180 includes a pair of upright (as viewed in FIG. 8) side sections 190 and 192. The upright side sections 190 and 192 of the actuator link 84 have vertical (as viewed in FIG. 8) central axes which extend perpendicular to and intersect a horizontal central axis of the base section 184. Transverse sections 194 and 196 extend inward from the side sections 190 and 192. The transverse sections 194 and 196 have coincident longitudinal central axes which extend parallel to the longitudinal central axis of the base section 184 and perpendicular to longitudinal central axes of the side sections 190 and 192. The longitudinal central axes of the side sections 190 and 192 extend parallel to the longitudinal central axis 173 of the body section 174 of the actuator member 140.

The return spring 146 is partially disposed between inner end portions of the transverse sections 194 and 196 (FIG. 8) of the actuator link 180. The return spring 146 is a helical coil spring and has a longitudinal central axis which extends perpendicular to the coincident central axes of the transverse sections 194 and 196. The central axis of the return spring 140 is offset, toward the right (as viewed in FIG. 8) from the central axes of the transverse sections 194 and 196. The vertical (as viewed in FIG. 8) central axis of the return spring 146 extends parallel to the central axis 173 of the actuator member 140 and to the central axes of the side sections 190 and 192 of the actuator link 180.

Cylindrical stop pins 200, 202, 204 and 206 extend from the base section 184 and transverse sections 194 and 196 of the actuator link 180. Thus, the stop pin 200 extends downward (as viewed in FIG. 8) from the transverse section 194 of the actuator link 180. The stop pin 202 extends upward from the base section 184 of the actuator link 180. The stop pins 200 and 202 have coincident central axes which extend parallel to the central axis of the side section 190 of the actuator link 180.

Similarly, the stop pin 204 extends downward (as viewed in FIG. 8) from the transverse section 196 of the actuator link 180. The stop pin 202 extends upward from the base section 184 of the actuator link 180. The stop pins 204 and 206 have coincident central axes which extend parallel to the central axis of the side section 192 of the actuator link 180.

The parallel arms 170 and 172 on the actuator member 140 are disposed midway between the stop pins 200–206 when the switch assembly 12 is in its initial or unactuated position (FIG. 8). Thus, the arm 170 is disposed midway between opposite ends of the stop pins 200 and 202. The arm 172 is disposed midway between the stop pins 204 and 206.

Actuator link springs 210, 212, 214 and 216 extend between the arms 170 and 172 on the actuator member 140 and the actuator link 180. The actuator link springs 210, 212, 214 and 216 are helical coil springs and have central axes which extend parallel to the central axis 22 of the housing 14 and to the central axis 173 of the actuator member 140. The central axes of the actuator link springs 210–216 extend through the push-button 32 and the upper and lower end portions 66 and 72 of the printed circuit 56.

The actuator link spring 210 extends between the transverse section 194 of the actuator link 180 and the arm 170 which extends from the actuator member 140. It should be understood that the actuator link spring 210 is assembled in a coaxial relationship with the stop pin 200 and has an upper end portion which presses against the transverse section 194 and a lower end portion which presses against the arms 170. The actuator link spring 210 has been shown offset from the stop pin 200 and the arm 170 in FIG. 8 for purposes of clarity of illustration of the stop pin 200.

Similarly, the actuator link spring 212 is disposed between the arm 170 of the actuator member 140 and the base section 184 of the actuator link 180 (FIG. 8). The actuator link spring 212 has a central axis which is coincident with the central axis of the stop pin 202. The actuator link spring 212 has been shown offset from the stop pin 202 and the arm 170 in FIG. 8 to clearly illustrate the stop pin. The actuator link springs 214 and 216 are mounted in a coaxial relationship with each other on opposite sides of the arm 172 in the same manner as in which the actuator link springs 210 and 212 are mounted on opposite sides of the arm 170 (FIG. 2). The central axes of the actuator link springs 214 and 216 are coincident with the central axes of the stop pins 204 and 206 (FIG. 8).

When the push-button 32 is in the initial position (FIG. 1), the actuator link springs 210, 212, 214 and 216 hold the actuator link 180 in an unactuated position. When the actuator link 180 is in the unactuated position, the arms 170 and 172 and actuator member 140 are disposed midway between the stop pins 200–206. Thus, the actuator arm 170 is disposed midway between the stop pins 200 and 202 while the actuator arm 172 is disposed midway between the stop pins 204 and 206.

Upon initial actuation of the push-button 32 (FIG. 1), the actuator member 140 moves downward (as viewed in FIG. 8). As this occurs, the actuator arms 170 and 172 move downward toward the base section 184 of the actuator link 180. The base section 184 of the actuator link 180 is held against downward movement by the actuator lever system 82.

The combined strength of the actuator lever springs 110 is greater than the strength of the actuator link springs 212 and 216. Therefore, as the push-button 32 is initially actuated and the actuator member 140 moves downward (FIG. 8), the actuator levers 88 hold the base section 184 against downward movement under the influence of force transmitted from the actuator arms 170 and 172 through the actuator springs 212 and 216 to the base section 184 of the actuator link 180. This results in the actuator link 180 being stationary as the actuator member 140 begins to move downward. As this occurs, the lower actuator link springs 212 and 216 are compressed by the actuator arms 170 and 172 and the upper actuator link springs 210 and 214 expand.

Upon engagement of the actuator arms 170 and 172 with the stop pins 202 and 206 (FIG. 8), the actuator link 180 begins to move downward. Thus, downward movement and force is transmitted from the push-button 32 through the actuator member 140 and arms 170 and 172 to the stop pins 202 and 206. This downward movement and force is transmitted to the end portions 96 of the actuator levers 88 by the base section 184 of the actuator link 180.

The downward force applied to the end portions 96 of the actuator levers 88 by the actuator link 180 causes the actuator levers to pivot, against the influence of the actuator lever springs 110, in a counterclockwise direction (as viewed in FIG. 5) about the end portions 92 of the actuator levers. This results in the actuator levers 88 being moved from the initial or unactuated position of FIG. 3 toward the intermediate position of FIG. 5 under the influence of force transmitted from the push-button 32. As the actuator levers 88 move toward the intermediate position shown in FIG. 5, the force applied by the actuator lever springs 110 resisting downward movement of the actuator link 180 is reduced. Therefore, as soon as the actuator levers 80 begin to move away from the initial position shown in FIG. 3 toward the intermediate position shown in FIG. 5, the amount of effort which is required to actuate the switch assembly 12 is reduced.

The return spring 146 is compressed during movement of the actuator member 140 prior to engagement of the arms 170 and 172 with the stop pins 202 and 206. In addition, the return spring 146 is compressed during movement of the actuator link 180 with the actuator member 140 after the arms 170 and 172 have engaged the stop pins 202 and 206. Therefore, the return spring 146 is effective to continuously oppose manual actuation of the switch assembly 12.

When the actuator member 140 moves downward through a slight distance from the intermediate position shown in FIG. 5, the actuator lever spring 110 pivots to an overcenter condition. This results in the actuator lever spring 110 urging the actuator lever 88 to pivot in a clockwise direction about the end portion 96 of the actuator lever. As this occurs, the movable switch contact 36 moves into engagement with the lower stationary switch contact 40 (FIG. 6) with a snap action.

Simultaneously therewith, the energy stored in the compressed actuator link springs 212 and 216 is released to move the end portions 96 of the actuator levers 88 downward from the position shown in FIG. 5 to the position shown in FIG. 6. The combined action of the actuator link springs 212 and 216 and the actuator lever springs 110 results in the movable switch contacts 34 being quickly moved out of engagement with the upper stationary switch contacts 38. The movable switch contacts 36 are moved into engagement with the lower stationary switch contacts 40 with a rapid snap action. The movable switch contacts 36 remain in engagement with the lower stationary switch contacts 40 as long as the push-button 32 is manually held in an actuated position.

Upon manual release of the push-button 32, the return spring 146 (FIGS. 2 and 8) moves the actuator member 140 upward. The actuator link 180 remains stationary in the actuated position shown in FIG. 6. This is because the actuator lever springs 110 resist pivotal movement of the actuator levers 88. The combined strength of the actuator lever springs 110 is more than sufficient to retain the actuator link 180 against upward movement.

The return spring 146 is strong enough to move the actuator member 140 upward (as viewed in FIG. 8) relative to the actuator link 180 when the push-button 32 is released. As this occurs, the lower actuator link springs 212 and 216 expand and the upper actuator link springs 210 and 214 are compressed. Upward (as viewed in FIG. 8) movement of the actuator member 140 relative to the actuator link 180 continues until the arms 170 and 172 on the actuator member 140 move into engagement with the stop pins 200 and 204 on the transverse sections 194 and 196 of the actuator link 180.

Upon engagement of the arms 170 and 172 on the actuator member 140 with the stop pins 200 and 204 on the transverse sections 194 and 196 of the actuator link 180, the actuator link begins to move upward (as viewed in FIG. 8) with the actuator member 140 under the influence of the return spring 146. The return spring 146 is strong enough to overcome the combined influence of the actuator lever springs 110. Therefore, once the arms 170 and 172 on the actuator member 140 have engaged the stop pins 200 and 204, the actuator link 180 moves upward and the actuator levers 88 are pivoted in a clockwise direction from the position shown in FIG. 6 toward the position shown in FIG. 7. As the actuator levers 88 are pivoted about their end portions 92 by the actuator link 180, the resistance provided by the actuator lever springs 110 decreases.

When the actuator levers 88 move upward through a slight distance from the position shown in FIG. 7 toward the position shown in FIG. 3, the actuator lever springs 110 pivot to an overcenter condition. The movable switch contacts 36 are quickly moved out of engagement with the lower stationary switch contacts 40. The movable switch contacts 34 are quickly moved into engagement with the upper stationary switch contacts 38. The snap action of the actuator lever springs 110 is assisted by the energy stored in the compressed actuator link springs 210 and 214. Thus, the stored energy in the actuator link springs 210 and 214 moves the actuator link 180 and end portions 96 of the actuator levers 88 upward.

Fast and reliable operation of the switch assembly 12 is promoted by moving the movable switch contacts 34 and 36 under the combined influence of the actuator lever system 82 and the actuator linkage system 84. Thus, the actuator lever system 82 uses over center springs 110 to effect movement of the switch contacts 34 and 36 with a snap action. The actuator mechanism 52 stores energy to effect rapid operation of the actuator lever system 82 at definite moments during manual actuation and release of the push-button 32.

It is contemplated that the actuator mechanism 52 could have a construction which is different than the illustrated construction. For example, the construction of the actuator linkage system 84 could be changed. Similarly, the construction of the actuator lever system 82 could be changed. However, the illustrated actuator mechanism 52 is believed to be advantageous in that it is compact and is operable to rapidly move the movable switch contacts 34 and 36.

Printed Circuit

The printed circuit 56 (FIG. 2) conducts electrical energy from terminals 26 in the fourth and fifth rows 60 and 62 of terminals to the push-button 32 to energize light sources 66 in the push-button. The lower end portion 72 of the printed circuit 56 is connected with the terminals 26 in the rows 60 and 62 of terminals. Electrical conductors (not shown) on the printed circuit 56 conduct electrical energy through the connector portion 78 and zig-zag portion 76 to the upper end portion 68 of the printed circuit 56. Electrical energy conducted through the printed circuit 56 is effective to energize the light sources 66 mounted on the upper end portion 68 of the printed circuit. The energized light sources 66 illuminate indicia (not shown) on the push-button 32.

The connector portion 78 of the printed circuit 76 extends through the actuator link 180 and the central axis 22 of the housing 14. Thus, the connector portion 78 extends between the lower stop pins 202 and 206 (FIG. 8) and between the lower actuator link springs 212 and 214. The connector portion 78 of the printed circuit 56 (FIG. 2) extends beneath the return spring 146. The connector portion 78 of the printed circuit 56 has a horizontal (as viewed in FIGS. 1 and 2) central axis which extends perpendicular to and intersects the central axis 173 and 22 of the actuator member 140 and housing 14.

The connector portion 78 of the printed circuit 56 has a flat horizontal upper side surface which faces upward toward the upper end portion 68 of the printed circuit and the push-button 32. Similarly, the connector portion 78 of the printed circuit 56 has a flat horizontal lower side surface which faces toward the lower end portion 72 of the printed circuit and the end wall 24 of the housing 14.

The bridge member 152 encloses the portion of the printed circuit 56 which extends beneath the return spring 146 to protect the printed circuit against wear or damage during repeated actuation of the switch assembly 12. Thus, the connector portion 78 of the printed circuit 56 extends through the passage 166 formed between the horizontal upper side wall 162 and the lower side wall 164 (FIG. 8) of the bridge member 152. Force applied to the bridge member 152 by the return spring 146 is transmitted through the vertical leg sections 158 and 160 (FIG. 8) to the end wall 24 of the housing 14.

The bridge member 152 extends through the actuator link 180 and extends across the actuator lever system 82. The bridge member 152 is disposed above (as viewed in FIG. 8) the upper stationary switch contacts 38. The bridge member 152 extends beneath the zig-zag portion 76 of the printed circuit 56.

The upper side wall 162 of the bridge member 164 extends beneath the actuator member 140 to eliminate any possibility of engagement of the actuator member with the printed circuit 56 (FIG. 1). Immediately to the right (as viewed in FIG. 1) of the actuator member 140, the connector portion 78 of the printed circuit 56 emerges from the passage 166 formed between the upper side wall 162 and lower side wall 164 of the bridge member 152 and is connected with the zig-zag portion 76 of the printed circuit. A slot is provided between the upper and lower side walls 162 and 164 in the bridge member 164 to enable the connector portion 78 of the printed circuit 56 to be inserted into the passage 166.

The connector portion 78 of the printed circuit 56 extends through the central axis 22 of the switch assembly 12 and the central axis 173 of the actuator member 140. The central axis of the connector portion 78 is perpendicular to and intersects the central axis 22 of the switch assembly 12 and the central axis 173 of the actuator member 140. The connector portion 78 of the printed circuit 56 extends from the left (as viewed in FIG. 1) side wall 16 of the housing 14 to a location disposed adjacent to and spaced slightly from the right (as viewed in FIG. 1) side wall of the housing 14. The connector portion 78 of the printed circuit is disposed between the actuator levers 88 and the push-button 32. Thus, the right (as viewed in FIG. 1) end of the connector portion 78 of the printed circuit 56 is connected with the zig-zag portion 76 of the printed circuit at a location disposed directly above the upper stationary switch contact 38 and the lower stationary switch contact 40.

The zig-zag portion 76 of the printed circuit 56 is disposed between the push-button 32 and the upper and lower stationary switch contacts 38 and 40. The zig-zag portion 76 of the printed circuit 56 includes linear horizontal sections 240 (FIG. 2) which are interconnected by arcuate bend sections 242. The linear sections 240 of the zig-zag portion of the printed circuit 76 have parallel horizontal central axes which extend perpendicular to the central axis 22 of the switch assembly 12. The arcuate bend sections 242 have centers of curvature which are disposed on horizontal (as viewed in FIG. 2) axes which extend perpendicular to the side walls 16 and 18 of the housing 14 and parallel to a central axis of the connector portion 78 of the printed circuit 56.

The arcuate bend sections 242 of the printed circuit 56 flex to enable the zig-zag portion 76 of the printed circuit to be extended and retracted. The right (as viewed in FIG. 1) edge of the zig-zag portion 76 of the printed circuit 56 is disposed adjacent to and spaced from the side wall 18 of the housing 14. The left edge of the zig-zag portion 76 of the printed circuit 56 is disposed adjacent to and spaced from the actuator member 140. This enables the zig-zag portion of the printed circuit to be extended and retracted without interference with either the actuator member 140 or the side wall 18 of the housing 14.

The upper end portion 68 of the printed circuit 56 is stiffened by a platform 248 (FIG. 2) which is connected with the upper end portion 68 of the printed circuit and the push-button 32. The light sources 66 are mounted directly on the upper end portion 68 of the printed circuit 56. Although the light sources 66, in the illustrated embodiment of the invention, are light emitting diodes, it should be understood that other types of light sources could be used if desired.

The switch contacts 34–40, actuator mechanism 52, and printed circuit 56 have a compact spatial relationship which enables them to fit into a relatively small housing 14. This compact spatial relationship is promoted by having the zig-zag portion 76 of the printed circuit disposed between the push-button 32 and the switch contacts 34–40. The compact construction of the switch assembly 12 is further promoted by having the connector portion 78 of the printed circuit 56 extend through the actuator mechanism 52. By conducting electrical energy to energize the light sources 66 in the push-button 32 through the zigzag portion 76 of the printed circuit 56, axial movement of the push-button 32 relative to the housing 14 is accommodated.

Conclusion

The present invention provides a new and improved switch assembly 12 having a housing 14 with a manually actuatable push-button 32 at one end. An actuator mechanism 52 is disposed within the housing 14 and is operable to move movable switch contacts 34 and 36 relative to stationary switch contacts 38 and 40 upon manual actuation of the push-button 32.

A printed circuit 56 is disposed within the housing 14. The printed circuit 56 has an end portion 68 connected with the push-button 32. Light sources 66 on the end portion 68 of the printed circuit 56 illuminate the push-button 32. A portion 76 of the printed circuit 56 has a zig-zag configuration to accommodate movement of the push-button 32 relative to the housing 14.

The actuator mechanism 52 includes a plurality of actuator levers 88. Movable switch contacts 34 and 36 are disposed at one end portion of each of the actuator levers 88 and a second end portion 96 of each of the actuator levers 88 is connected with an actuator link 180. The actuator link 180 is movable relative to the housing 14 to pivot the actuator levers 88 about the end portions 92 upon which the movable switch contacts 34 and 36 are disposed. Actuator lever springs 110 are provided to move the movable switch contacts 34 and 36 relative to stationary switch contacts 38 and 40.

Having described the invention, the following is claimed:

1. A switch assembly comprising a housing, a manually actuatable push-button connected with and movable relative to said housing, a first plurality of stationary switch contacts disposed in said housing, a second plurality of stationary switch contacts disposed in said housing adjacent to and spaced from said first plurality of stationary switch contacts, a plurality of longitudinally extending actuator levers disposed in said housing, each of said actuator levers having a first end portion and a second end portion, a plurality of movable switch contacts each of which is connected with the first end portion of one of said actuator levers, said actuator levers being pivotal about their first and second end portions, an actuator link connected with said push-button and with said second end portions of said actuator levers, said actuator link being movable relative to said housing under influence of force transmitted to said actuator link from said push-button upon manual actuation of said push-button, said actuator link being movable in a first direction from a first position to a second position upon manual actuation of said push-button to pivot said actuator levers about the first end portions of said actuator levers with said movable switch contacts in engagement with said first plurality of stationary switch contacts, said actuator link being movable in the first direction from the second position to a third position upon continued manual actuation of said push-button, and a plurality of actuator lever springs to pivot said actuator levers about the second end portions of said actuator levers to move said movable switch contacts away from said first plurality of stationary switch contacts into engagement with said second plurality of stationary switch contacts during movement of said actuator link to the third position.

2. A switch assembly as set forth in claim 1 wherein said actuator link is movable from the third position to a fourth position in a second direction which is opposite to the first direction upon manual release of said push-button with said actuator link in the third position to pivot said actuator levers about the first end portions of said actuator levers with said movable switch contacts in engagement with said second plurality of stationary switch contacts, said actuator link being movable in the second direction from the fourth position to the first position, said plurality of actuator lever springs being operable to pivot said actuator levers about the second end portions of said actuator levers to move said movable switch contacts away from said second plurality of stationary switch contacts into engagement with said first plurality of stationary switch contacts during movement of said actuator link to the first position.

3. A switch assembly as set forth in claim 1 further including an actuator link spring connected with said actuator link and operable to move said actuator link and said second end portions of said actuator levers relative to said housing in the first direction during movement of said actuator link from the second position to the third position.

4. A switch assembly as set forth in claim 1 further including a plurality of members fixedly connected with said housing, and a plurality of pivot levers, each of said pivot levers having a first end portion disposed in engagement with a member of said plurality of members and a second end portion which is disposed in engagement with said second end portion of one of said actuator levers, said pivot levers being pivotal relative to said members and said actuator levers upon pivotal movement of said actuator levers.

5. A switch assembly as set forth in claim 1 wherein each one of said actuator levers includes surface means for defining an opening in said one actuator lever, said switch assembly further including a plurality of pivot members each of which is fixedly connected with said housing and extends through said opening in one of said actuator levers, and a plurality of pivot levers, each of said pivot levers having a first end portion disposed in engagement with one of said pivot members and a second end portion disposed in engagement with an end portion of said opening in one of said actuator levers, each of said actuator lever springs having a first end portion disposed in engagement with one of said pivot members and a second end portion disposed in engagement with an end portion of said opening in one of said actuator levers.

6. A switch assembly as set forth in claim 1 further including an actuator member connected with said push-button, said actuator member having a main section and an arm section extending outward from said main section, said actuator link having a base section which is connected with said second end portions of said actuator levers, a side section which extends from said base section, and a transverse section which is connected with said side section, a first actuator link spring disposed between said base section of said actuator link and said arm section of said actuator member, and a second actuator link spring disposed between said transverse section of said actuator link and said arm section of said actuator member, said arm section of said actuator member moving toward said base section of said actuator link to resiliently compress said first actuator link spring during movement of said actuator link from the first position to the second position, said first actuator link spring being resiliently expandable to move said actuator link in the first direction during movement of said actuator link from the second position toward the third position.

7. A switch assembly as set forth in claim 6 further including a printed circuit disposed in said housing, said printed circuit having a first end portion connected with said housing, a second end portion which is connected with said push-button and is movable with said push-button relative to said housing upon manual actuation of said push-button, said printed circuit having a portion with a zig-zag configuration and a connector portion which extends between said first end portion and said portion with a zig-zag configuration, said connector portion being at least partially disposed between said actuator member and said plurality of actuator levers.

8. A switch assembly as set forth in claim 6 further including a printed circuit disposed in said housing, said printed circuit having a first end portion connected with said housing, a second end portion which is connected with said push-button and is movable with said push-button relative to said housing upon manual actuation of said push-button, said printed circuit having an intermediate portion which is connected with said first and second end portions and is disposed between said actuator member and said plurality of actuator levers.

9. A switch assembly as set forth in claim 7 wherein said intermediate portion of said printed circuit includes a zig-zag portion which is disposed between said second end portion of said printed circuit and a portion of said printed circuit which extends between said actuator member and said plurality of actuator levers.

10. A switch assembly as set forth in claim 1 further including a printed circuit disposed in said housing, said printed circuit having a first end portion connected with said housing at a location which is at least partially disposed between said second end portions of said actuator levers and a first end of said housing, said printed circuit having a second end portion connected with said push-button adjacent a second end of said housing opposite from said first end of said housing, said second end portion of said printed circuit being movable with said push-button relative to said housing, said printed circuit having a zig-zag portion connected with said first and second end portions of said printed circuit and at least partially disposed between said first end portions of said actuator levers and said push-button, and a plurality of light sources disposed on said second end portion of said printed circuit to illuminate at least a portion of said push-button.

11. A switch assembly comprising a housing having first and second end portions, said housing having a longitudinal central axis which extends through said first and second end portions of said housing, a plurality of stationary switch contacts disposed in said housing adjacent to the first end portion of said housing, a plurality of movable switch contacts disposed in said housing adjacent to the first end portion of said housing, a manually actuatable push-button disposed adjacent to the second end portion of said housing, an actuator mechanism disposed in said housing and connected with said push-button and said movable switch contacts, said actuator mechanism being operable to move said movable switch contacts relative to said stationary switch contacts upon manual actuation of said push-button, said actuator mechanism including a member which is connected with said push-button at a location along the longitudinal central axis of said housing, a portion of said actuator mechanism being offset from the longitudinal central axis of said housing toward a first side wall of said housing, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration and being disposed between said push-button and said stationary and movable switch contacts, said intermediate portion of said printed circuit having a zig-zag configuration being offset from the longitudinal central axis of said housing toward a second side wall of said housing, said second side wall of said housing being disposed opposite from and facing inward toward said first side wall of said housing, and a plurality of light sources disposed on said second end portion of said printed circuit to illuminate at least a portion of said push-button.

12. A switch assembly as set forth in claim 11 wherein said actuator mechanism includes a plurality of coil springs having central axes which extend through said push-button and through said first and second end portions of said printed circuit.

13. A switch assembly as set forth in claim 11 wherein said intermediate portion of said printed circuit having a zig-zag configuration includes a plurality of segments which are interconnected by arcuate bends having central axes which extend through said first and second side walls of said housing.

14. A switch assembly as set forth in claim 11 wherein said printed circuit includes a portion which extends from said first end portion of said printed circuit through said actuator mechanism to said intermediate portion of said printed circuit having a zig-zag configuration.

15. A switch assembly as set forth in claim 11 wherein said printed circuit includes a connector portion which extends from said first end portion of said printed circuit through the longitudinal central axis of said housing to said intermediate portion of said printed circuit having a zig-zag configuration.

16. A switch assembly as set forth in claim 15 wherein said connector portion of said printed circuit extends through said actuator mechanism.

17. A switch assembly as set forth in claim 15 wherein said connector portion of said printed circuit extends through the longitudinal central axis of said housing at a location between said push-button and said first end portion of said housing.

18. A switch assembly as set forth in claim 15 wherein said connector portion of said printed circuit has a first side which faces toward said first end portion of said printed circuit and a second side which faces toward said second end portion of said printed circuit.

19. A switch assembly as set forth in claim 15 wherein said intermediate portion of said printed circuit having a zig-zag configuration includes a plurality of segments which are interconnected by arcuate bends having central axes which extend generally parallel to a longitudinal central axis of said connector portion of said printed circuit.

20. A switch assembly as set forth in claim 11 wherein said actuator mechanism includes a plurality of longitudinally extending actuator levers disposed adjacent to said first end portion of said housing, said actuator levers having first and second end portions, each of said movable switch contacts being connected with the first end portion of one of said actuator levers, said actuator levers being pivotal about their first end portions, and an actuator link connected with said push-button and said second end portions of said actuator levers, said actuator link being movable relative to said housing under the influence of force transmitted from said push-button upon manual actuation of said push-button to pivot said plurality of actuator levers about their first end portions.

21. A switch assembly as set forth in claim 20 wherein said actuator mechanism further includes a plurality of actuator lever springs connected with said actuator levers and operable to move said first end portions of said actuator levers and said movable switch contacts relative to said fixed switch contacts upon pivotal movement of said actuator levers from a first position to a second position by said actuator link.

22. A switch assembly as set forth in claim 20 wherein said intermediate portion of said printed circuit having a zigzag configuration is disposed between said first end portions of said actuator levers and said push-button.

23. A switch assembly comprising a housing having first and second end portions, said housing having a longitudinal central axis which extends through said first and second end portions of said housing, a plurality of stationary switch contacts disposed in said housing adjacent to the first end portion of said housing, a plurality of movable switch contacts disposed in said housing adjacent to the first end portion of said housing, a manually actuatable push-button disposed adjacent to the second end portion of said housing, an actuator mechanism disposed in said housing and connected with said push-button and said movable switch contacts, said actuator mechanism being operable to move said movable switch contacts relative to said stationary switch contacts upon manual actuation of said push-button, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration and being disposed between said push-button and said stationary and movable switch contacts, said printed circuit including a connector portion which extends from said first end portion of said printed circuit through the longitudinal central axis of said housing to said intermediate portion of said printed circuit having a zig-zag configuration, said connector portion of said printed circuit having a first side which faces toward said first end portion of said printed circuit and a second side which faces toward said second end portion of said printed circuit, and a plurality of light sources disposed on said second end portion of said printed circuit to illuminate at least a portion of said push-button.

24. A switch assembly as set forth in claim 23 wherein said connector portion of said printed circuit extends through said actuator mechanism.

25. A switch assembly as set forth in claim 23 wherein said connector portion of said printed circuit extends through the central axis of said housing at a location between said push-button and said first end portion of said housing.

26. A switch assembly as set forth in claim 23 wherein said intermediate portion of said printed circuit having a zig-zag configuration includes a plurality of segments which are interconnected by arcuate bends having central axes which extend generally parallel to a longitudinal central axis of said connector portion of said printed circuit.

27. A switch assembly as set forth in claim 23 wherein a portion of said actuator mechanism is offset from the longitudinal central axis of said housing toward a first side wall of said housing, said intermediate portion of said printed circuit having a zig-zag configuration being offset from the longitudinal central axis of said housing toward a second side wall of said housing, said second side wall of said housing being disposed opposite from and facing inward toward said first side wall of said housing.

28. A switch assembly as set forth in claim 23 wherein said actuator mechanism includes a coil spring having a central axis which extends through said push-button and through said first and second end portions and said connector portion of said printed circuit.

29. A switch assembly as set forth in claim 23 wherein said intermediate portion of said printed circuit having a zig-zag configuration includes a plurality of segments which are interconnected by arcuate bends having central axes which extend parallel to at least portions of said first and second sides of said connector portion of said printed circuit.

30. A switch assembly comprising a housing having first and second end portions, a plurality of stationary switch contacts disposed in said housing adjacent to the first end portion of said housing, a plurality of movable switch contacts disposed in said housing adjacent to the first end portion of said housing, a manually actuatable push-button disposed adjacent to the second end portion of said housing, an actuator mechanism disposed in said housing and connected with said push-button and said movable switch contacts, said actuator mechanism being operable to move said movable switch contacts relative to said stationary switch contacts upon manual actuation of said push-button, said actuator mechanism includes a plurality of longitudinally extending actuator levers disposed adjacent to said first end portion of said housing, said actuator levers having first and second end portions, each of said movable switch contacts being connected with the first end portion of one of said actuator levers, said actuator levers being pivotal about their first end portions, and an actuator link connected with said push-button and said second end portions of said actuator levers, said actuator link being movable relative to said housing under the influence of force transmitted from said push-button upon manual actuation of said push-button to pivot said plurality of actuator levers about their first end portions, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration and being disposed between said push-button and said stationary and movable switch contacts, and a plurality of light sources disposed on said second end portion of said printed circuit to illuminate at least a portion of said push-button.

31. A switch assembly as set forth in claim 30 wherein said actuator mechanism further includes a plurality of actuator lever springs connected with said actuator levers and operable to move said first end portions of said actuator levers and said movable switch contacts relative to said fixed switch contacts upon pivotal movement of said actuator levers from a first position to a second position by said actuator link.

32. A switch assembly as set forth in claim 31 wherein said actuator mechanism further includes an actuator link spring connected with said actuator link and operable to move said actuator link and said second end portions of said actuator levers relative to said housing upon movement of said first end portions of said actuator levers by said actuator lever springs.

33. A switch assembly as set forth in claim 31 wherein said actuator mechanism further includes a plurality of pivot members fixedly connected with said first end portion of said housing, and a plurality of pivot levers, each of said pivot levers having a first end portion disposed in engagement with a pivot member and a second end portion which is disposed in engagement with said second end portion of one of said actuator levers, said pivot levers being pivotal relative to said pivot members and said actuator levers upon pivotal movement of said actuator levers by said actuator link.

34. A switch assembly as set forth in claim 30 wherein said intermediate portion of said printed circuit having a zig-zag configuration is disposed between said first end portions of said actuator levers and said push-button.

35. A switch assembly as set forth in claim 30 wherein each one of said actuator levers includes surface means for defining an opening in said one actuator lever, said actuator mechanism further including a plurality of pivot members each of which extends through an opening in one of said actuator levers, a plurality of pivot levers, each of said pivot levers having a first end portion disposed in engagement with one of said pivot members and a second end portion disposed in engagement with an end portion of an opening in one of said actuator levers, and a plurality of actuator lever springs, each of said actuator lever springs having a first end portion disposed in engagement with one of said pivot members and a second end portion disposed in engagement with an opening in one of said actuator levers.

36. A switch assembly comprising a housing having first and second end portions, a plurality of stationary switch contacts disposed in said housing adjacent to the first end portion of said housing, said plurality of stationary switch contacts includes a first plurality of stationary switch contacts and a second plurality of stationary switch contacts, a plurality of movable switch contacts disposed in said housing adjacent to the first end portion of said housing, a manually actuatable push-button disposed adjacent to the second end portion of said housing, an actuator mechanism disposed in said housing and connected with said push-button and said movable switch contacts, said actuator mechanism being operable to move said movable switch contacts relative to said stationary switch contacts upon manual actuation of said push-button, said actuator mechanism including an actuator member connected with said push-button, return spring means for providing force which is transmitted through said actuator member to said push-button urging said push-button toward an initial position relative to said housing, an actuator link connected with said actuator member and with said movable switch contacts, said actuator member being movable from a first position to a second position relative to said actuator link under influence of force transmitted from said push-button to said actuator member upon manual actuation of said push-button and movement of said push-button and actuator member relative to said housing against influence of said return spring while said movable switch contacts are disposed in engagement with said first plurality of stationary switch contacts, said actuator member being movable from the second position to a third position under influence of force transmitted from said push-button to said actuator member and against influence of said return spring upon continued manual actuation of said push-button, said actuator link being movable with said actuator member relative to said housing during movement of said actuator member from the second position to the third position, said movable switch contacts remaining in engagement with said first plurality of stationary switch contacts during movement of said actuator member from the second position to the third position, and means for moving said actuator link relative to said actuator member and for moving said movable switch contacts out of engagement with said first plurality of stationary switch contacts into engagement with said second plurality of stationary switch contacts upon movement of said actuator member from the third position during continued manual actuation of said push-button, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration and being disposed between said push-button and said stationary and movable switch contacts, and a plurality of light sources disposed on said second end portion of said printed circuit to illuminate at least a portion of said push-button.

37. A switch assembly as set forth in claim 36 wherein said means for moving said actuator link relative to said actuator member and for moving said movable switch contacts includes a plurality of actuator link springs disposed between said actuator link and said actuator member, said actuator member being effective to resiliently compress at least one of said actuator link springs during movement of said actuator member from the first position to the second position, said at least one of said actuator link springs being resiliently expandable to move said actuator link relative to said actuator member upon movement of said actuator member from the third position.

38. A switch assembly as set forth in claim 37 wherein a portion of said printed circuit extends through said actuator link between springs of said plurality of actuator link springs.

39. A switch assembly comprising a housing having first and second end portions, a plurality of stationary switch contacts disposed in said housing adjacent to the first end portion of said housing, said plurality of stationary switch contacts includes a first plurality of stationary switch contacts and a second plurality of stationary switch contacts, a plurality of movable switch contacts disposed in said housing adjacent to the first end portion of said housing, a manually actuatable push-button disposed adjacent to the second end portion of said housing, an actuator mechanism disposed in said housing and connected with said push-button and said movable switch contacts, said actuator mechanism being operable to move said movable switch contacts relative to said stationary switch contacts upon manual actuation of said push-button, said actuator mechanism including an actuator member connected with said push-button, said actuator member having a main section and a plurality of arm sections extending outward from said main section, an actuator link, said actuator link having a base section which is connected with said movable switch contacts, a plurality of side sections which extend from said base section, and a plurality of transverse sections which extend from said side sections, a first plurality of actuator link springs disposed between said base section of said actuator link and said arm sections of said actuator member, and a second plurality of actuator link springs disposed between said transverse sections of said actuator link and said arm sections of said actuator member, said actuator member being movable in a first direction from a first position to a second position relative to said housing under influence of force transmitted from said push-button to said actuator member upon manual actuation of said push-button to move said push-button away from an initial position, said arm sections of said actuator member moving toward said base section of said actuator link to resiliently compress said first plurality of actuator link springs during movement of said actuator member from the first position to the second position relative to said housing, said movable switch contacts being disposed in engagement with said first plurality of stationary switch contacts during movement of said actuator member from the first position to the second position, said actuator member being movable in the first direction from the second position to a third position relative to said housing upon continued manual actuation of said push-button, said first plurality of actuator link springs being resiliently expandable to move said actuator link in the first direction relative to said actuator member during movement of said actuator member from the second position toward the third position, said movable switch contacts moving out of engagement with said first plurality of stationary switch contacts and into engagement with said second plurality of stationary switch contacts during movement of said actuator link in the first direction relative to said actuator member, said actuator member being movable in a second direction opposite to the first direction from the third position toward a fourth position relative to said housing upon manual release of said push-button with said actuator member in the third position, said arm sections of said actuator member moving away from said base section of said actuator link to enable said first plurality of actuator link springs to resiliently expand during movement of said actuator member from the third position toward the fourth position relative to said housing, said arm sections of said actuator member moving toward said transverse sections of said actuator link to resiliently compress said second plurality of actuator link springs during movement of said actuator member from the third position toward the fourth position relative to said housing, said movable switch contacts being disposed in engagement with said second plurality of stationary switch contacts during movement of said actuator member from the third position toward the fourth position, said actuator member being movable in the second direction from the fourth position to the first position relative to said housing, said second plurality of actuator link springs being resiliently expandable to move said actuator link in the second direction relative to said actuator member during movement of said actuator member from the fourth position toward the first position, said movable switch contacts moving out of engagement with said second plurality of stationary switch contacts and into engagement with said first plurality of stationary switch contacts during movement of said actuator link in the second direction relative to said actuator member, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration and being disposed between said push-button and said stationary and movable switch contacts, and a plurality of light sources disposed on said second end portion of said printed circuit to illuminate at least a portion of said push-button.

40. A switch assembly as set forth in claim 39 wherein a portion of said printed circuit extends through a space between said side sections of said actuator link.

41. A switch assembly comprising a housing having first and second end portions, first and second pluralities of terminals disposed adjacent to said first end portion of said housing, a manually actuatable push-button disposed adjacent to said second end portion of said housing, a printed circuit disposed in said housing, said printed circuit having a first end portion which is connected with said first plurality of terminals, said printed circuit having a second end portion which is connected with said push-button and is movable with said push-button relative to said housing upon manual actuation of said push-button, said printed circuit including an intermediate portion which is connected with said second end portion of said printed circuit and has a zig-zag configuration, said intermediate portion of said printed circuit including a plurality of segments which are interconnected by arcuate bends having central axes which extend through said housing at locations between first and second end portions of said housing, said printed circuit having a connector portion which interconnects said first end portion of said printed circuit and said intermediate portion of said printed circuit, said connector portion of said printed circuit being offset to one side of said intermediate portion of said printed circuit, said connector portion of said printed circuit having a central axis which extends transversely to said segments of said intermediate, portion of said printed circuit, said connector portion of said printed circuit has a first major side surface area which faces toward said first end portion of said housing and said first end portion of said printed circuit, said connector portion of said printed circuit having a second major side surface area which faces toward said push-button and said second end portion of said printed circuit, a plurality of stationary switch contacts disposed in said housing and connected with said second plurality of terminals, a plurality of movable switch contacts disposed in said housing, an actuator mechanism disposed in said housing and connected with said movable switch contacts and said push-button, said actuator mechanism being operable to move said movable switch contacts relative to said stationary switch contacts upon manual actuation of said push-button, and a plurality of light sources disposed on said second end portion of said printed circuit to illuminate at least a portion of said push-button under influence of electrical energy conducted from said first plurality of terminals to said light sources through said printed circuit.

42. A switch assembly as set forth in claim 41 wherein said connector portion of said printed circuit extends through said actuator mechanism.

43. A switch assembly as set forth in claim 41 further including a biasing spring which urges said push-button toward an initial position relative to said housing and an enclosure which at least partially encloses said connector portion of said printed circuit, said biasing spring being disposed in engagement with said enclosure.

44. A switch assembly as set forth in claim 43 wherein said enclosure and said connector portion of said printed circuit extend through said actuator mechanism.

45. A switch assembly as set forth in claim 41 wherein said segments of said intermediate portion of said printed circuit have central axes which are offset in a first direction from a central axis of said switch assembly, said first end portion of said printed circuit being connected with said first plurality of terminals at a location which is offset in a second direction from the central axis of said switch assembly, said connector portion of said printed circuit extending through the central axis of said switch assembly.

46. A switch assembly as set forth in claim 41 wherein said actuator mechanism includes a plurality of longitudinally extending actuator levers disposed adjacent to said first end portion of said housing, each of said actuator levers having a first end portion and a second end portion, each of said movable switch contacts being connected with the first end portion of one of said actuator levers, said intermediate portion of said printed circuit being at least partially disposed between said first end portions of said actuator levers and said push-button.

47. A switch assembly as set forth in claim 46 wherein said actuator levers are pivotal about their first and second end portions, said actuator mechanism further including an actuator link connected with said second end portions of said actuator levers, said actuator link being movable relative to said housing under influence of force transmitted to said actuator link from said push-button to pivot said actuator levers about the first end portions of said actuator levers upon manual actuation of said push-button, at least a portion of said connector portion of said printed circuit being disposed between at least a portion of said actuator link and said push-button.

48. A switch assembly as set forth in claim 41 further including a bridge member which extends across said movable and stationary switch contacts, said connector portion of said printed circuit being disposed in engagement with said bridge member.

49. A switch assembly as set forth in claim 48 further including a return spring which applies force to said bridge member and said push-button to urge said push-button toward an initial position relative to said housing.

50. A switch assembly comprising a housing having first and second end portions, said housing having a longitudinal central axis which extends through said first and second end portions of said housing, a plurality of stationary switch contacts disposed in said housing adjacent to the first end portion of said housing, a plurality of movable switch contacts disposed in said housing adjacent to the first end portion of said housing, a manually actuatable push-button disposed adjacent to the second end portion of said housing, an actuator mechanism disposed in said housing and operable to effect movement of said movable switch contacts relative to said stationary switch contacts upon manual actuation of said push-button, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit being offset to one side of the longitudinal central axis of said housing and having a zig-zag configuration, said printed circuit having a connector portion which extends from said first end portion of said printed circuit through the longitudinal central axis of said housing to said intermediate portion of said printed circuit which is offset to one side of the longitudinal central axis of said housing, and a plurality of light sources disposed on said second end portion of said printed circuit to illuminate at least a portion of said push-button.

51. A switch assembly as set forth in claim 50 wherein at least a portion of said actuator mechanism is offset from the longitudinal central axis of said housing toward a first side wall of said housing, said intermediate portion of said printed circuit having a zig-zag configuration being offset from the longitudinal central axis of said housing toward a second side wall of said housing, said connector portion of said printed circuit extends through the portion of said actuator mechanism which is offset from the longitudinal central axis of said housing.

52. A switch assembly as set forth in claim 50 wherein said actuator mechanism includes first and second coil springs having central axes which extend through said push-button, said connector portion of said printed circuit extends between the central axes of said first and second coil springs.

53. A switch assembly as set forth in claim 50 wherein said actuator mechanism includes a plurality of longitudinally extending actuator levers disposed adjacent to said first end portion of said housing, each of said actuator levers having a first end portion and a second end portion, each of said movable switch contacts being connected with the first end portion of one of said actuator levers, said intermediate portion of said printed circuit being at least partially disposed between said first end portions of said actuator levers and said push-button.

54. A switch assembly as set forth in claim 50 further including a bridge member which extends through the longitudinal central axis of said housing and across said movable and stationary switch contacts, said connector portion of said printed circuit being disposed in engagement with said bridge member.

55. A switch assembly as set forth in claim 54 wherein said actuator mechanism includes a return spring which provides force which is transmitted to said bridge member and said push-button to urge said push-button toward an initial position relative to said housing.

56. A switch assembly as set forth in claim 50 further including means for supporting said connector portion of said printed circuit, said means for supporting said connector portion of said printed circuit includes a support member which extends through the longitudinal central axis of said housing at a location between said first and second end portions of said housing.

57. A switch assembly as set forth in claim 50 further including a support having first and second spaced apart sections which extend from said first end portion of said housing toward said second end portion of said housing and a third section which extends between said first and second sections of said support and extends through the longitudinal central axis of said housing at a location between and spaced from said first and second end portions of said housing, said connector portion of said printed circuit being supported by said third section of said support.

58. A switch assembly as set forth in claim 57 wherein said actuator mechanism applies force against said third section of said support, said first and second sections of said support being effective to transmit force from said third section of said support to said first end portion of said housing.

59. A switch assembly as set forth in claim 58 wherein said third section of said support at least partially encloses said connector portion of said printed circuit.

60. A switch assembly comprising a housing having first and second end portions, a plurality of stationary switch contacts disposed in said housing adjacent to the first end portion of said housing, a plurality of movable switch contacts disposed in said housing adjacent to the first end portion of said housing, a manually actuatable push-button disposed adjacent to the second end portion of said housing, an actuator mechanism disposed in said housing and operable to effect movement of said movable switch contacts relative to said stationary switch contacts upon manual actuation of said push-button, a printed circuit disposed in said housing, said printed circuit having a first end portion which is connected with the first end portion of said housing, said printed circuit having a second end portion which is connected with said push-button and is movable with said push-button relative to said housing upon manual actuation of said push-button, said printed circuit having an intermediate portion which is connected with said first and second end portions of said printed circuit, said intermediate portion of said printed circuit having a zig-zag configuration, said printed circuit having a connector portion which extends from said first end portion of said printed circuit through said actuator mechanism to said intermediate portion of said printed circuit, and a plurality of light sources disposed on said second end portion of said printed circuit to illuminate at least a portion of said push-button.

61. A switch assembly as set forth in claim 60 wherein said housing has a longitudinal central axis which extends through said first and second end portions of said housing, at least a portion of said actuator mechanism being offset from the longitudinal central axis of said housing, said connector portion of said printed circuit extends through the portion of said actuator mechanism which is offset from the longitudinal central axis of said housing.

62. A switch assembly as set forth in claim 60 wherein said actuator mechanism includes a plurality of coil springs having central axes which extend through said push-button, said connector portion of said printed circuit extends between the central axis of said first and second coil springs.

63. A switch assembly as set forth in claim 60 further including a bridge member which extends through said actuator mechanism, said connector portion of said printed circuit being disposed in engagement with said bridge member.

64. A switch assembly as set forth in claim 63 wherein said actuator mechanism includes a return spring having a first end portion from which force is transmitted to said bridge member and a second end portion from which force is transmitted to said push-button to urge said push-button toward an initial position relative to said housing.

65. A switch assembly as set forth in claim 64 wherein said return spring has a longitudinal central axis which extends through said connector portion of said pointed circuit and through said pushbutton.

66. A switch assembly as set forth in claim 60 wherein said actuator mechanism includes an actuator member connected with said push-button, an actuator link connected with said movable switch contacts, and first and second springs which transmit force between said actuator link and said actuator member, said connector portion of said printed circuit extends through said actuator mechanism at a location which is disposed between said first and second springs.

67. A switch assembly as set forth in claim 60 wherein said actuator mechanism includes a spring which urges said pushbutton toward an initial position, said switch assembly further including support means for supporting said connector portion of said printed circuit and for transmitting force from said spring to said housing, said support means includes a support member which extends through said actuator mechanism and receives force from said spring.

68. A switch assembly as set forth in claim 60 further including a support having first and second spaced apart sections which extend from said first end portion of said housing toward said second end portion of said housing and a third section which extends between said first and second sections of said support and extends through said actuator mechanism at a location between and spaced from said first and second end potions of said housing, said connector portion of said printed circuit being supported by said third section of said support.

69. A switch assembly as set forth in claim 68 wherein said actuator mechanism applies force against said third section of said support, said first and second sections of said support being effective to transmit force from said third section of said support to said first end portion of said housing.

70. A switch assembly as set forth in claim 69 wherein said third section of said support at least partially encloses said connector portion of said printed circuit.

71. A switch assembly comprising a housing having first and second end portions, a plurality of terminals disposed adjacent to said first end portion of said housing, a manually actuatable push-button disposed adjacent to said second end portion of said housing, a printed circuit disposed in said housing, said printed circuit having a first end portion which is connected with said plurality of terminals, said printed circuit having a second end portion which is connected with said push-button and is movable with said push-button relative to said housing upon manual actuation of said push-button, said printed circuit including an intermediate portion which is connected with said second end portion of said printed circuit and has a zig-zag configuration, said printed circuit having a connector portion which interconnects said first end portion of said printed circuit and said intermediate portion of said printed circuit, an enclosure which is connected with said housing and at least partially encloses said connector portion of said printed circuit, a plurality of stationary switch contacts disposed in said housing, a plurality of movable switch contacts disposed in said housing, an actuator mechanism disposed in said housing and connected with said movable switch contacts and said push-button, said actuator mechanism being operable to move said movable switch contacts relative to said stationary switch contacts upon manual actuation of said push-button, said actuator mechanism including a spring which urges components of said actuator mechanism toward an initial condition, said spring having an end portion which is disposed in engagement with said enclosure which at least partially encloses said connector portion of said printed circuit, and a plurality of light sources disposed on said second end portion of said printed circuit to illuminate at least a portion of said push-button under the influence of electrical energy conducted from said plurality of terminals to said light sources through said printed circuit.

72. A switch assembly as set forth in claim 71 wherein said connector portion of said printed circuit has a first major side surface area which faces toward said first end portion of said housing and said first end portion of said printed circuit, said connector portion of said printed circuit having a second major side surface area which faces toward said push-button and said second end portion of said printed circuit.

73. A switch assembly as set forth in claim 71 wherein said connector portion of said printed circuit extends through said actuator mechanism.

74. A switch assembly as set forth in claim 71 wherein said enclosure and said connector portion of said printed circuit extend through said actuator mechanism.

75. A switch assembly as set forth in claim 71 wherein said intermediate portion of said printed circuit is offset in a first direction from a central axis of said switch assembly, said first end portion of said printed circuit being connected with said first plurality of terminals at a location which is offset in a second direction from the central axis of said switch assembly, said connector portion of said printed circuit and said enclosure extend through the central axis of said switch assembly.

76. A switch assembly as set forth in claim 71 wherein said actuator mechanism includes a plurality of longitudinally extending actuator levers disposed adjacent to said first end portion of said housing, each of said actuator levers having a first end portion and a second end portion, each of said movable switch contacts being connected with the first end portion of one of said actuator levers, said intermediate portion of said printed circuit being at least partially disposed between said first end portions of said actuator levers and said push-button.

77. A switch assembly as set forth in claim 71 wherein said actuator levers are pivotal about their first and second end portions, said actuator mechanism further including an actuator link connected with said second end portions of said actuator levers, said actuator link being movable relative to said housing under the influence of force transmitted to said actuator link from said push-button to pivot said actuator levers about the first end portions of said actuator levers upon manual actuation of said push-button, at least a portion of said connector portion of said printed circuit being disposed between at least a portion of said actuator link and said push-button.

* * * * *